US011298722B2

(12) United States Patent
Sun et al.

(10) Patent No.: US 11,298,722 B2
(45) Date of Patent: Apr. 12, 2022

(54) AUTOMATIC LABELING PRODUCTION LINE FOR SOLID STATE DISK

(71) Applicant: World Precision Manufacturing (Dongguan) Co., Ltd., Dongguan (CN)

(72) Inventors: Jinsuo Sun, Dongguan (CN); Yu Shen, Dongguan (CN); Xiaofei Nan, Dongguan (CN); Jianjin Liang, Dongguan (CN)

(73) Assignee: WORLD PRECISION MANUFACTURING (DONGGUAN) CO., LTD., Dongguan (CN)

( * ) Notice: Subject to any disclaimer, the term of this patent is extended or adjusted under 35 U.S.C. 154(b) by 479 days.

(21) Appl. No.: 16/205,908

(22) Filed: Nov. 30, 2018

(65) Prior Publication Data

US 2019/0308220 A1 Oct. 10, 2019

(30) Foreign Application Priority Data

Apr. 9, 2018 (CN) ..... 201810312190.9

(51) Int. Cl.
*B07C 5/34* (2006.01)
*B07C 5/344* (2006.01)
(Continued)

(52) U.S. Cl.
CPC ..... *B07C 5/3412* (2013.01); *B07C 5/344* (2013.01); *B65C 1/025* (2013.01); *B65C 9/30* (2013.01); *B65C 9/40* (2013.01); *B65C 2009/407* (2013.01)

(58) Field of Classification Search
CPC .. B65C 1/025; B65C 9/30; B65C 9/40; B65C 9/44; B65C 2009/402; B65C 2009/407;
(Continued)

(56) References Cited

U.S. PATENT DOCUMENTS

2003/0102367 A1* 6/2003 Monette ..... G05B 19/41865 235/376
2010/0027868 A1* 2/2010 Kosaka ..... G01N 35/1016 382/134
2013/0011629 A1* 1/2013 Brandon ..... B65C 9/1865 428/192

FOREIGN PATENT DOCUMENTS

CN 106938729 A * 7/2017 ..... B65C 9/0006
FR 2719283 A1 * 11/1995 ..... B65C 1/025

OTHER PUBLICATIONS

Translation of FR 2719283 A1, Nov. 1995, Premysl Hartman (Year: 1995).*
Translation of CN 106938729A, Deng S, Jul. 2017 (Year: 2017).*

* cited by examiner

*Primary Examiner* — George R Koch
(74) *Attorney, Agent, or Firm* — Shimoka Aji IP

(57) ABSTRACT

An automatic labeling production line for solid state disk includes a production conveyor belt, a fixture disposed on the production conveyor belt and provided with a fixture code, and a loading mechanism provided with a product scanning mechanism detecting the memory and marking out a first defective memory, a first fixture scanning mechanism, a first and a second recycling mechanism recycling a defective memory, an automatic labeling mechanism, a visual inspection mechanism, a second fixture scanning mechanism identifying the fixture code, and an unloading mechanism unloading the memory which are arranged along the production conveyor belt in turn. The first fixture scanning mechanism scans the fixture code and records the original code and the corresponding fixture code. The visual inspection mechanism detects the memory and marks out a second defective memory. Thus, the production line is simplified,
(Continued)

automatic labeling for memory is achieved, and the label process is more flexible.

10 Claims, 14 Drawing Sheets

(51) Int. Cl.
*B65C 1/02* (2006.01)
*B65C 9/30* (2006.01)
*B65C 9/40* (2006.01)

(58) Field of Classification Search
CPC .. B65C 2009/408; B07C 5/3412; B07C 5/344
See application file for complete search history.

AUTOMATIC LABELING PRODUCTION LINE FOR SOLID STATE DISK

RELATED APPLICATIONS

This application claims the benefit of priority to Chinese Patent Application No. 201810312190.9 filed on Apr. 9, 2018, which is hereby incorporated by reference in its entirety.

FIELD OF THE INVENTION

The present invention relates to a field of labeling for a memory of a solid state disk, and more particularly to an automatic labeling production line for solid state disk.

BACKGROUND OF THE INVENTION

Usually, when a solid state disk is labeled, it's a need to test original memory to screen out defective memories, and then qualified memories are loaded onto a labeling device for labeling. Furthermore, after labeled, the memory is transferred to a testing device to check whether the memory is wrongly labeled. If the memory is wrongly labeled, it will be loaded and unloaded again, and the operation is complex and error-prone.

Moreover, since the relationship between an original code and a print code on the memory is not recorded when the original solid state disk is labeled, the original code on the memory does not match to a newly printed label, and it is difficult to record label process of the memory. If things go wrong, it takes a lot of work to find out the wrong memory. If the original code of the memory is missing or corrupted, the memory cannot be traced.

Furthermore, when the solid state disk is labeled, the label on the memory can only be modified manually. When the memory on the production line need to be changed, it need to be changed manually, or even the production line need to be suspended, which reduces production efficiency and wastes manpower.

Thus, it is necessary to provide an automatic labeling production line for solid state disk to solve the problem mentioned above.

SUMMARY OF THE INVENTION

One objective of the present invention is to provide an automatic labeling production line for solid state disk, which simplifies the production line, automatically labels a memory, and is more flexible in labeling.

To achieve the above objective, an automatic labeling production line for solid state disk is provided, adapted for labeling a memory of the solid state disk, includes a production conveyor belt, a plurality of fixtures disposed on the production conveyor belt for holding the memory, and a loading mechanism, a first fixture scanning mechanism, a first recycling mechanism, an automatic labeling mechanism, a visual inspection mechanism, a second fixture scanning mechanism, a second recycling mechanism and an unloading mechanism which are arranged along the production conveyor belt in turn. Moreover, the fixture is provided with a fixture code, and the loading mechanism is provided with a product scanning mechanism. Specifically, the loading mechanism is arranged for loading the memory to the fixture at a loading port. The product scanning mechanism is arranged for detecting an original code of the memory and marking out a first defective memory. The first fixture scanning mechanism is arranged for scanning the fixture code and recording the original code and the corresponding fixture code. The first recycling mechanism is arranged for recycling the first defective memory, and the automatic labeling mechanism is arranged for printing a memory label and pasting the memory label onto the memory. Furthermore, the visual inspection mechanism is arranged for detecting the memory label and marking out a second defective memory, and the second fixture scanning mechanism is arranged for identifying the fixture code. Furthermore, the second recycling mechanism is arranged for recycling the second defective memory, and the unloading mechanism is arranged for unloading the memory.

In comparison with the prior art, a fixture code is set on the fixture, and the original code and the fixture code of the memory are scanned during the labeling. As a result, the original code and the fixture code of the memory are matched, and the memory with a wrong original code can be found by means of the fixture code on the labeling production line, which enables the first recycling mechanism to be labeled on the production line, which effectively simplifies the production line and realizes automatic labeling of the memory. Furthermore, the production line of the present invention can also recognize a memory held on the fixture, so that the automatic labeling mechanism can print the corresponding memory label according to the original code of the memory, and pastes the memory label onto the memory. Therefore, the memory label can be printed and pasted on the memory according to the original code, and the different memories can be simultaneously labeled on the same production line without stopping the production line. Also, the labeling parameters are set in advance so that different memory labels are attached to different batches or specifications memories. Thus, labeling memory labels is more flexible and saves labor, the relationship between the specific original code and the printed memory label can be easily recognized, and the memory is traced in time.

Preferably, the production conveyor belt is a fixture conveyor belt which includes a belt body, a drive mechanism, and a fixture sliding rail parallel to the belt body. Specifically, the fixture includes a fixture body, and a placement groove for placing the memory is defined on an upper end surface of the fixture body. Moreover, a fixture slider that is slidably engaged with the fixture sliding rail is disposed on a lower side of the fixture body, and a clamping slot is penetrated through a side wall of the fixture body and clamped on the belt body to move together with the belt body.

Preferably, a retaining groove is formed on the side wall of the fixture, and a retaining cylinder is disposed at a processing position of the production conveyor belt. Specifically, a positioning block is disposed at an end of the retaining cylinder and extended into the retaining groove, and the retaining cylinder controls the positioning block to extend out to limit the fixture. Moreover, the fixture conveyor belt rotates incessantly, so that the devices on the production line can be arranged more flexibly, and it is convenient to coordinate each device.

Preferably, the automatic labeling production line further includes a return conveyor belt and two fixture transfer mechanisms. Specifically, the return conveyor belt is also a fixture conveyor belt, and the clamping slots are respectively defined on left and right side walls of the fixture body. Two ends of the belt body respectively are extended to form two ends of the fixture sliding rail, one of the fixture transfer mechanisms is disposed between a first end of the fixture sliding rail of the production conveyor belt and a second end of a fixture sliding rail of the return conveyor belt which is opposite to each other and is arranged for unloading the fixture on the second end of the return conveyor belt and then loading the fixture to the first end of the production conveyor belt. Furthermore, another one of the fixture transfer mechanisms is disposed between a second end of the fixture sliding rail of the production conveyor belt and a first end of the fixture sliding rail of the return conveyor belt which are opposite to each other and is arranged for unloading the fixture on the second end of the production conveyor belt and loading the fixture to the first end of the return conveyor belt.

Concretely, front and rear side walls of the fixture body are provided with openings that are oppositely disposed and penetrated from left to right. Moreover, the fixture transfer mechanism includes a guiding sliding rail disposed between the production conveyor belt and the return conveyor belt, a bearing slider slidably mounted on the guiding sliding rail, a return drive portion that drives the bearing slider to move back and forth along the guiding sliding rail, and a limiting rail mounted on both sides of the guiding sliding rail and engaged with the openings on both sides of the fixture. Furthermore, a bearing rail is formed on the bearing slider and connected with the fixture sliding rail.

Preferably, the loading mechanism includes a feeding device and a loading conveying mechanism. Specifically, the feeding device includes a material shelf, a clamping assembly, and a lifting assembly. Furthermore, the material shelf has a material area for holding material trays which is for carrying the memory. Furthermore, the clamping assembly includes a driving motor mounted on a body frame, two rotating shafts driven by the driving motor, and a main clamping assembly. Specifically, the main clamping assembly includes two main clamping portions respectively mounted on the two rotating shafts, and a separation area is formed between the two rotating shafts and located above the material area. Each of the main clamping portions includes a main cam mounted on the rotating shaft and a main clamping block following the main cam. To be specific, the main cam is driven by the rotating shaft to drive the two main clamping blocks to stretch into and withdraw from the separation area; and the lifting assembly is connected with the material shelf to control movement of the material shelf, and the loading conveying mechanism is arranged for clamping the memory on the material tray from the separation area and transferring the memory to the fixture on the production conveyor belt.

Preferably, the clamping assembly further includes a holding assembly and a subordinate clamping assembly. Specifically, the holding assembly includes two holding portions arranged respectively on the two rotating shafts. Moreover, each of the holding portions includes a holding cam and a holding block following the holding cam. The two holding blocks are driven by the two holding cams respectively to stretch into the separation area to clamp the material tray or withdraw from the separation area to release the material tray. Moreover, the subordinate clamping assembly includes a front clamping portion located on a front side of the separation area and a rear clamping portion located on a rear side of the separation area. To be Specific, the front clamping portion includes a front cam mounted on the rotating shaft and a front clamping block following the front cam, and the front clamping block is driven by the front cam to stretch out or withdraw from the front edge of the separation area. Furthermore, the rear clamping portion includes a rear cam mounted on the rotating shaft, a rear clamping block following the rear cam, and a guiding member fixed to the body frame and connected to the rear clamping block. Furthermore, the rear clamping block is driven by the rear cam to stretch out or withdraw from the rear edge of the separation area under the limitation of the guiding member. Furthermore, the rotating shafts are rotatable among an initial station, a holding station, a clamping station and an unloading station. Specifically, the main cam the holding cam, and the front and the rear cams are distributed along a periphery of the rotating shaft at a certain angle, the main clamping assembly, the holding assembly and the subordinate clamping assembly are released when the rotating shaft are rotated to the initial station; the holding assembly and the front clamping block are driven to stretch into the separation area to hold the material tray when the rotating shafts are rotated to the holding station; the clamping assembly and the rear clamping block are driven to stretch into the separation area to clamp the material tray when the rotating shafts are rotated to the clamping station; and the main clamping portion is driven to clamp, the holding assembly, the front clamping portion and the rear clamping portion are driven to withdraw when the rotating shafts are rotated to the unloading station; and when the rotating shafts are rotated from the unloading station to the initial station, the lifting assembly is arranged for controlling the material shelf to approach the clamping assembly and moving the material tray on a top of a material area to the separation area at the initial station; and when the rotating shafts are rotated from the holding station to the clamping station, the lifting assembly is arranged for controlling the material shelf to be away from the clamping assembly, and the material tray at the top of the material area is separated from the material shelf at the clamping station.

Preferably, both the first recycling mechanism and the second recycling mechanism are a defective product recycling mechanism for recycling defective memory. Specifically, the defective product recycling mechanism includes a recycling box and a recycling transmission portion. Furthermore, the recycling box is provided with a defective product placement area, a defective product removal area, and a first conveying rail and a second conveying rail arranged between the defective product placement area and the defective product removal area in parallel. Furthermore, the first conveying rail and the second conveying rail are respectively slidably mounted with a recycling container for holding the memory. The recycling transmission portion is arranged for clamping the defective memory on the production line and transferring the defective memory to the defective product placement area for unloading.

Preferably, each of the fixtures has N placement grooves for placing the memories. N is an integer greater than or equal to 1. Specifically, the automatic labeling mechanism includes N labeling positions, N label conveying mechanism corresponding to N labeling positions respectively, and a rolling mechanism disposed behind the N labeling positions. Each of the labeling positions is provided with a third fixture scanning mechanism for scanning the fixture code, and an automatic label printer for printing a memory label is arranged at a position corresponding to each of the labeling positions. Each of the label conveying mechanisms is arranged for respectively transferring a memory label printed by the corresponding automatic label printer to the labeling position, and the rolling mechanism is arranged for rolling the memory label to stick the memory label.

Preferably, the automatic label printer includes a label printing unit, a label output table, a label inspection unit, and a label position confirmation unit. Specifically, the label printing unit is arranged for printing a memory label and outputting the memory label to the label output table. The label inspection unit is used for checking whether the memory label at the label output table is printed incorrectly. When the memory label is printed incorrectly, the label printing unit is arranged for reprinting and recycling the wrong memory label. The label conveying mechanism is arranged for gripping the memory label and conveying the memory label to a label position confirmation unit; and moreover, the label position confirmation unit is arranged for confirming a position of the memory label on a robot of the label conveying mechanism. Furthermore, the label conveying mechanism is arranged for conveying the memory label from the label position confirmation unit to the labeling position, and adjusting an angle and a position of the robot at the labeling position according to a position of the memory label on the robot of the label conveying mechanism, so that the memory label is faced to a position of the memory to be labeled on the fixture. Moreover, the label inspection mechanism is used to check if the printed memory label is wrong, thereby increasing yield.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1A:
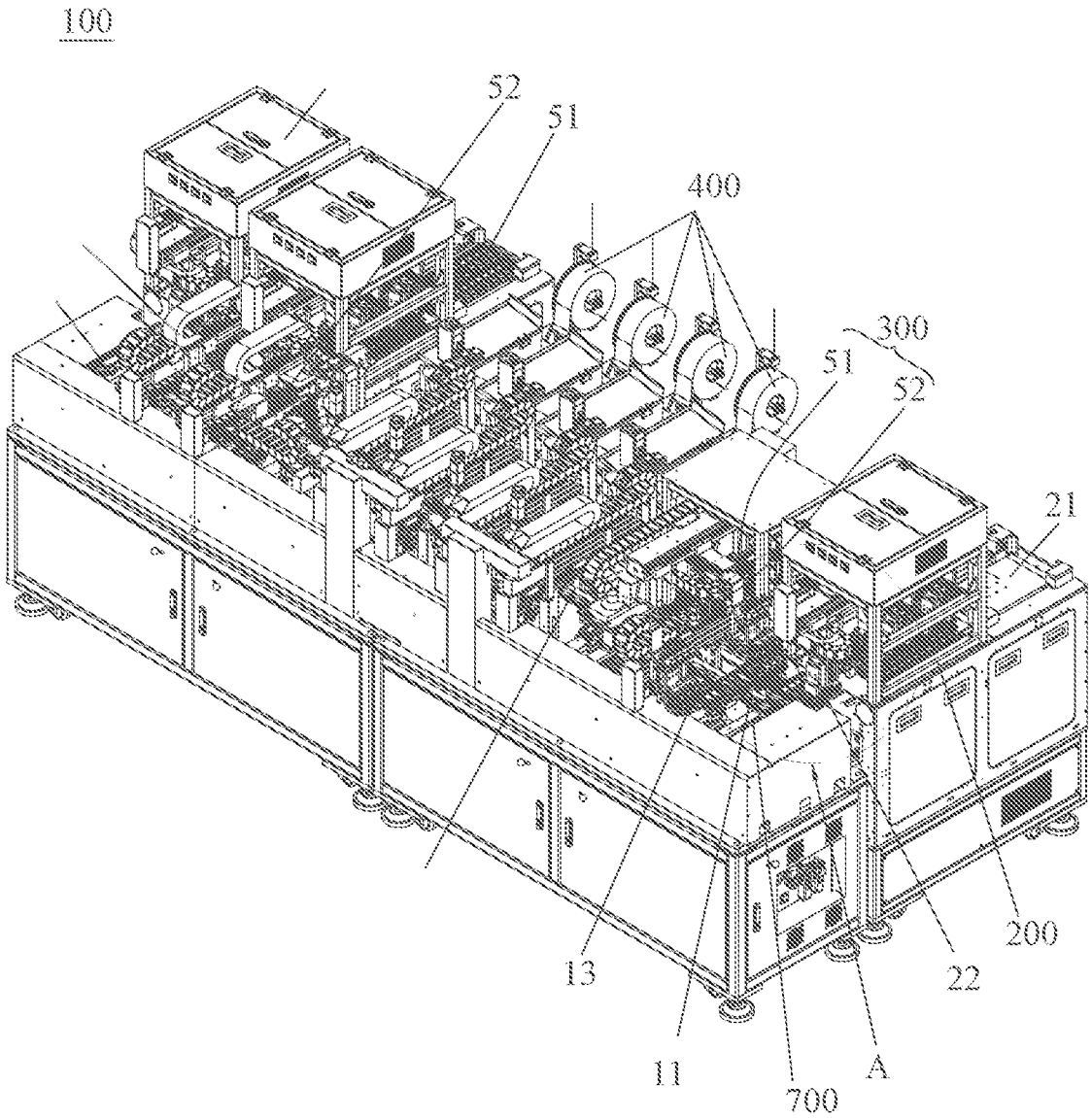
FIG. 1*a* is a perspective view of an automatic labeling production line for solid state disk according to one embodiment of the present invention.

A distinct and full description of the technical solution of the present invention will follow by combining with the accompanying drawings.

Referring to FIGS. 1*a*-3, an automatic labeling production line for solid state disk 100, which is used for labeling a memory 102 of the solid state disk, includes a production conveyor belt 13, and a loading port 11, a first fixture scanning mechanism 15, a first recycling mechanism 300, an automatic labeling mechanism 400, a visual inspection mechanism 16, a second fixture scanning mechanism 17, a second recycling mechanism 500 and an unloading port 12 which are arranged along the production conveyor belt 13 in turn. In addition, a loading mechanism 200 and a product scanning mechanism 201 are disposed on the loading port 11, and an unloading mechanism 600 is arranged on the unloading port 12. A plurality of fixtures 800 provided with a fixture code is disposed on the production conveyor belt 13 and is arranged for holding the memory 102. Specifically, the production conveyor belt 13 sequentially conveys the fixture 800, and the loading mechanism 200 is arranged for loading the memory 102 to the fixture 800 at the loading port 11. The product scanning mechanism 201 is arranged for detecting an original code of the memory 102 conveyed to the loading port 11 and marking out a first defective memory. The first fixture scanning mechanism 15 is arranged for scanning the fixture code and recording the original code and the corresponding fixture code. The first recycling mechanism 300 is arranged for recycling the defective memory, and the automatic labeling mechanism 400 is arranged for printing a memory label and pasting the memory label onto the memory 102. The visual inspection mechanism 16 is arranged for detecting the memory label and marking out a second defective memory, and the second fixture scanning mechanism 17 is arranged for identifying the fixture code and confirming whether a defective memory is carried and the position of the defective memory thereon. Furthermore, the second recycling mechanism 500 is arranged for recycling the second defective memory, and the unloading mechanism 600 is arranged for unloading the qualified memory 102. In addition, the fixture label is attached on the bottom of the fixture 800, and the fixture scanning mechanism includes the first fixture scanning mechanism 15, the second fixture scanning mechanism 17, and a third fixture scanning mechanism 18.

Figure 4:
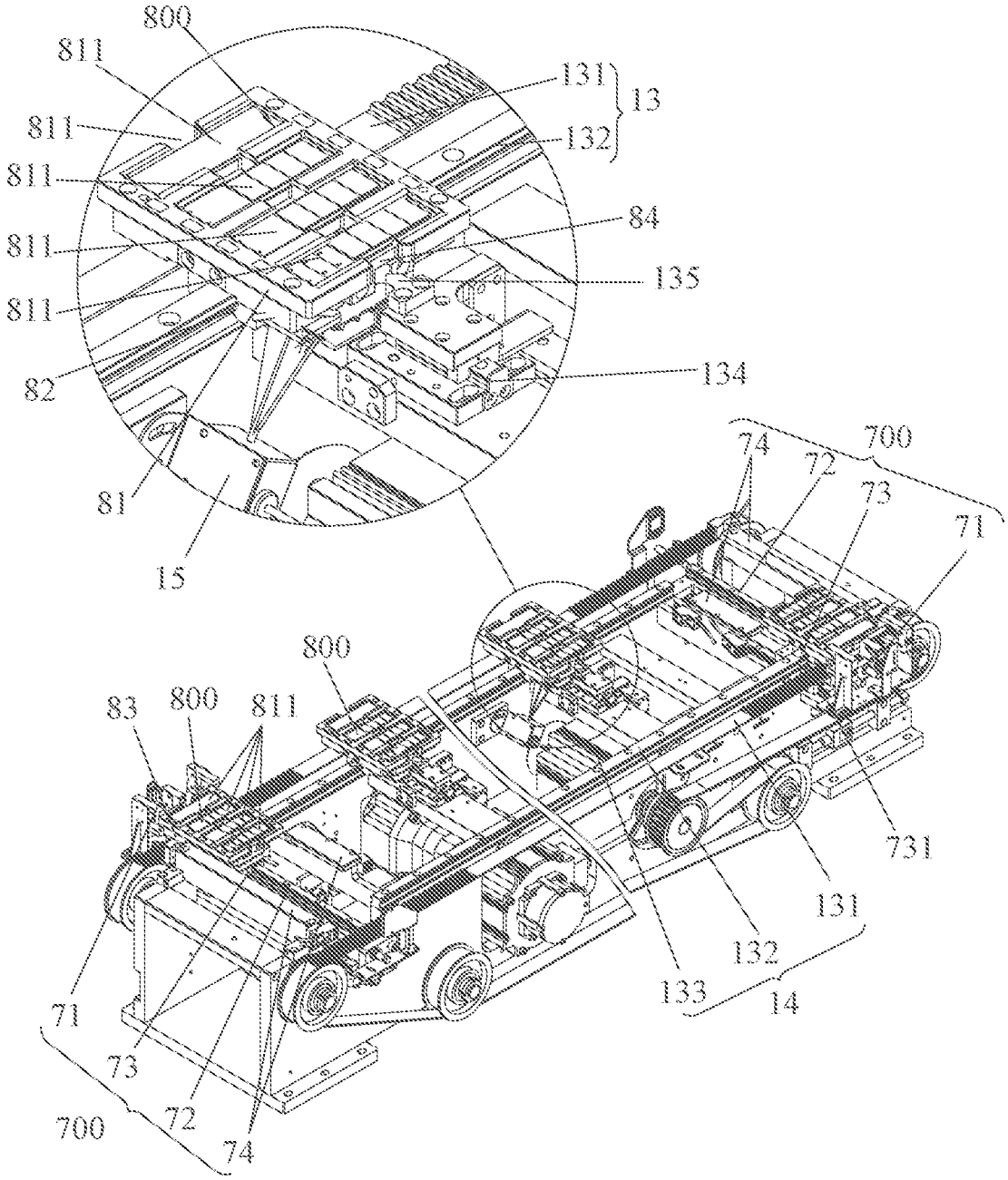
FIG. 4 is a partial enlarged view of FIG. 2.

As shown in FIG. 4, the production conveyor belt 13 and the return conveyor belt 14 is a fixture conveyor belt which includes a belt body 131, a drive mechanism 132, and a fixture sliding rail 133 parallel to the belt body 131.

Figure 2:
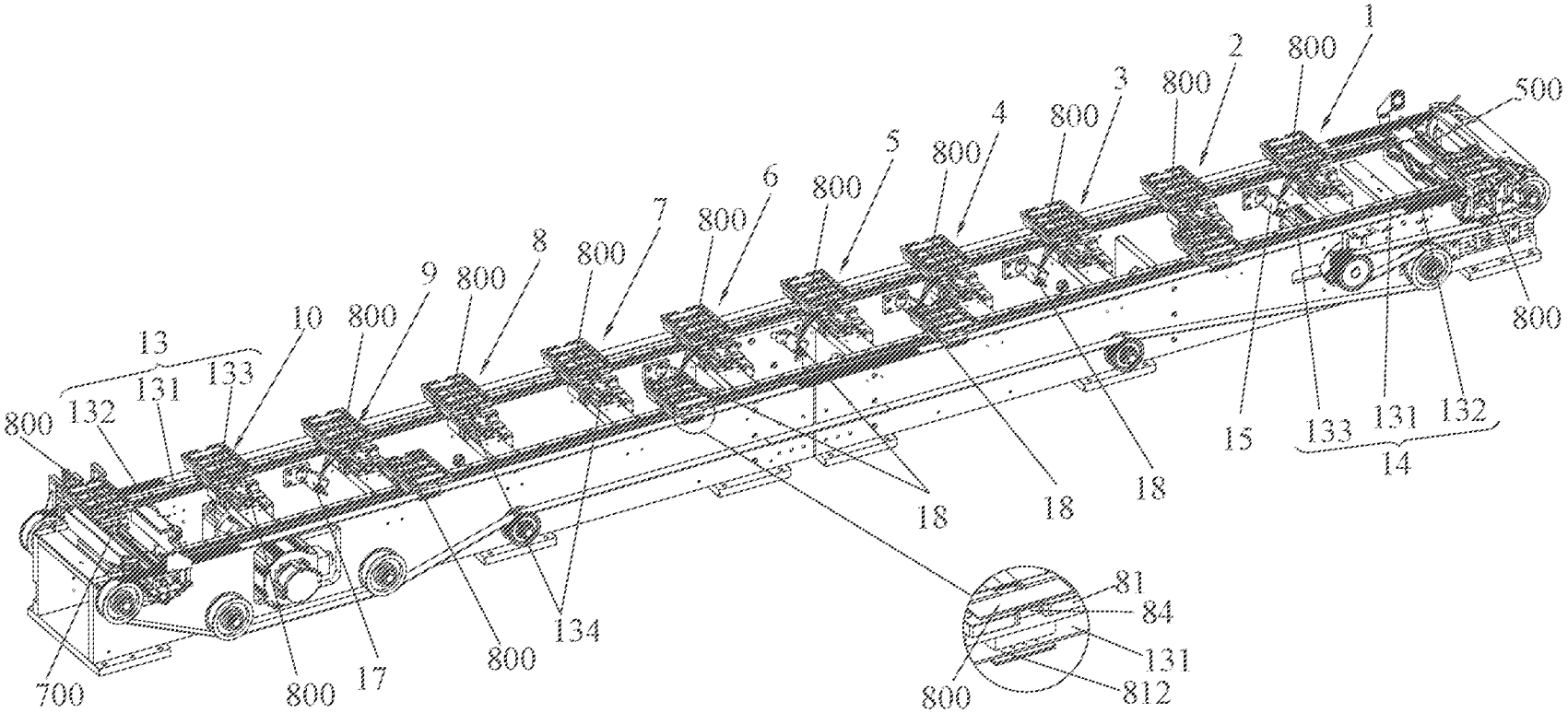
FIG. 2 is a partial perspective view of the automatic labeling production line for solid state disk according to one embodiment of the present invention.
Figure 5:
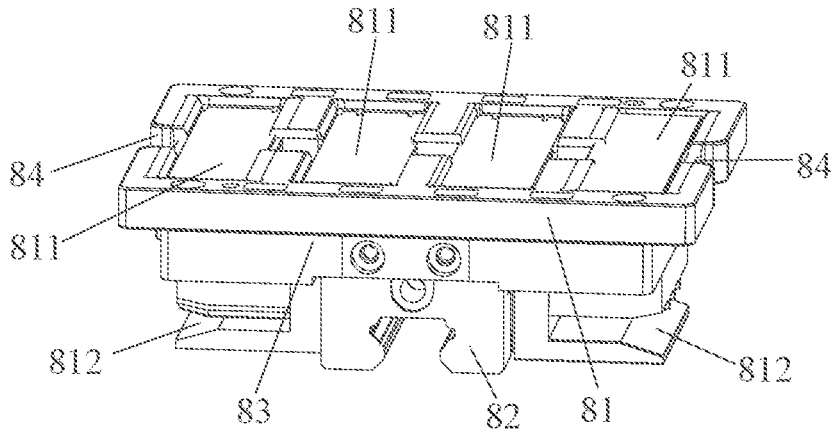
FIG. 5 is a perspective view of a fixture according to one embodiment of the present invention.

Referring to FIGS. 2 and 4-5, a retaining groove 84 is formed on the side wall of the fixture 800, and a retaining cylinder 134 is disposed at a processing position of the production conveyor belt 13. Specifically, a positioning block 135 is disposed at an end of the retaining cylinder 134 and extended into the retaining groove 84, and the retaining cylinder 134 is arranged for controlling the positioning block 135 to extend out to limit the fixture 800.

Referring to FIGS. 2 and 4-5, the fixture 800 includes a fixture body 81, and a placement groove 811 for placing the memory 102 is defined on an upper end surface of the fixture body 81. Moreover, a fixture slider 82 that is slidably engaged with the fixture sliding rail 133 is disposed on a lower side of the fixture body 81, and a clamping slot 812 is penetrated through a side wall of the fixture body 81 and clamped on the belt body 131 to move together with the belt body 131. Concretely, front and rear side walls of the fixture body 81 are provided with openings 83 that are oppositely disposed and penetrated from left to right. In this embodiment, the fixture 800 has four placement grooves 811, so that the fixture 800 can carry four memories at a time. Of course, the number of the placement grooves 811 can also be 1, 2, 3, etc. The retaining groove 84 is located above the clamping slot 812.

As shown in FIGS. 2 and 4, the fixture transfer mechanism 700 includes a guiding sliding rail 72 disposed between the production conveyor belt 13 and the return conveyor belt 14, a bearing slider 73 slidably mounted on the guiding sliding rail 72, a return drive portion 71 that drives the bearing slider 73 to move back and forth along the guiding sliding rail 72, and a limiting rail 74 mounted on both sides of the guiding sliding rail 72 and engaged with the openings 83 on both sides of the fixture 800. Furthermore, a bearing rail 731 is formed on the bearing slider 73 and connected with the fixture sliding rail 133. Specifically, the limiting rail 74 includes two plates placed at opposite position.

Figure 1B:
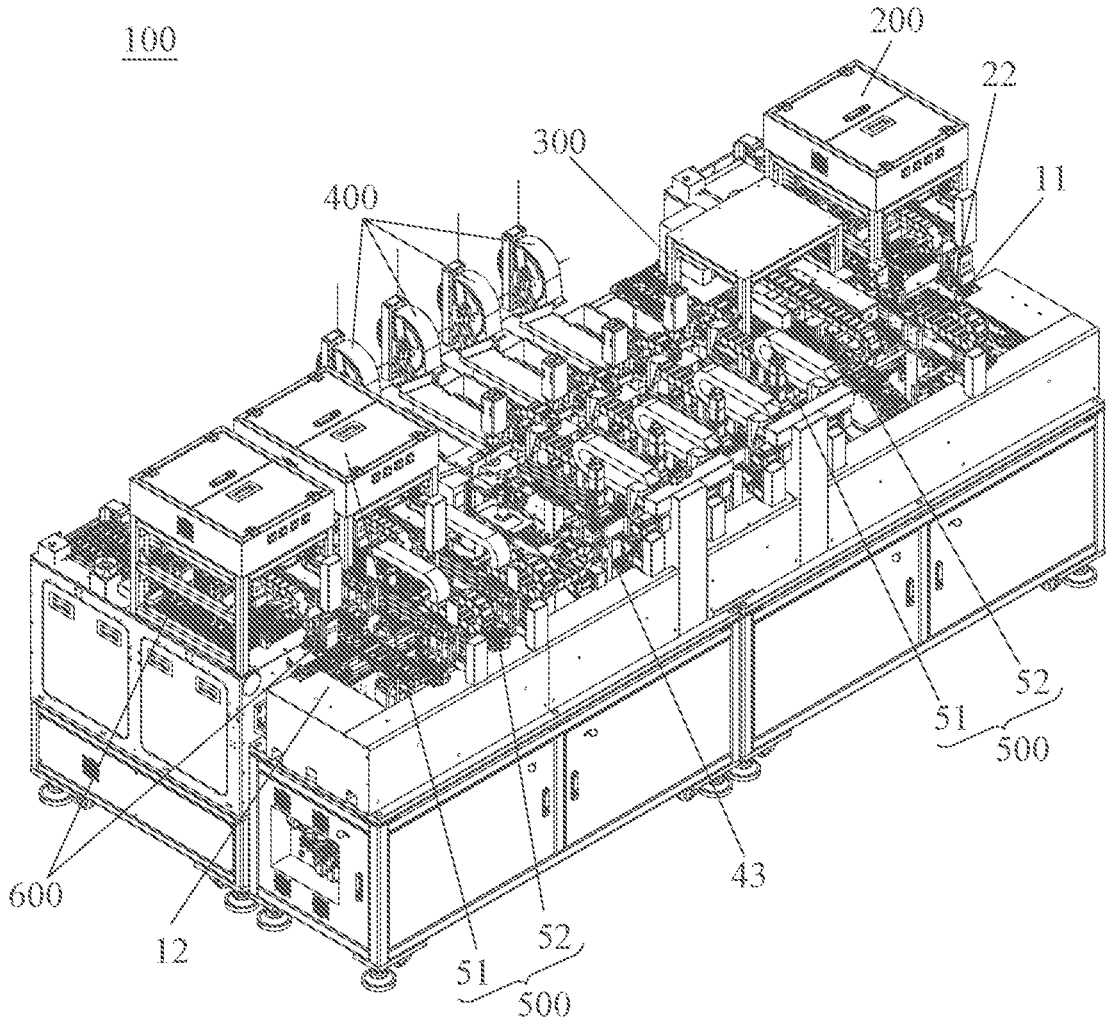
FIG. 1*b* is a perspective view of the automatic labeling production line for solid state disk viewed from another angle.
Figure 9:
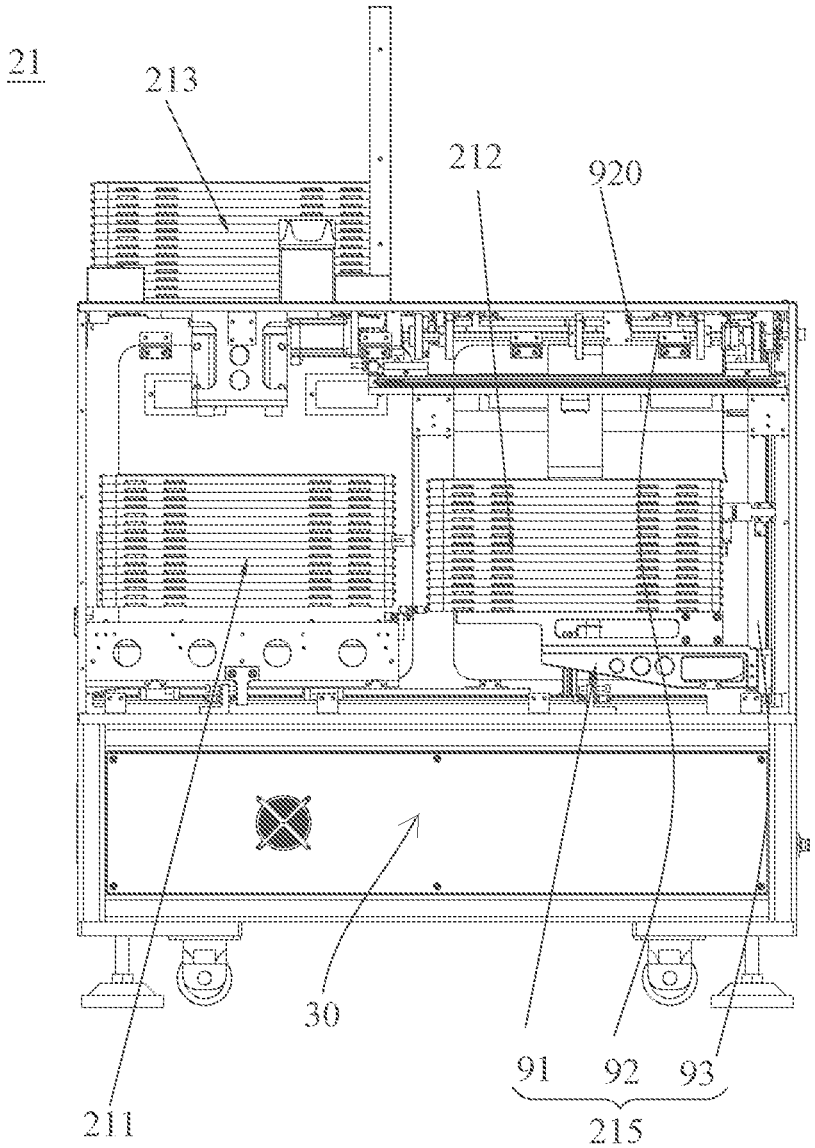
FIG. 9 is a side elevation view of the loading mechanism according to one embodiment of the present invention.
Figure 10:
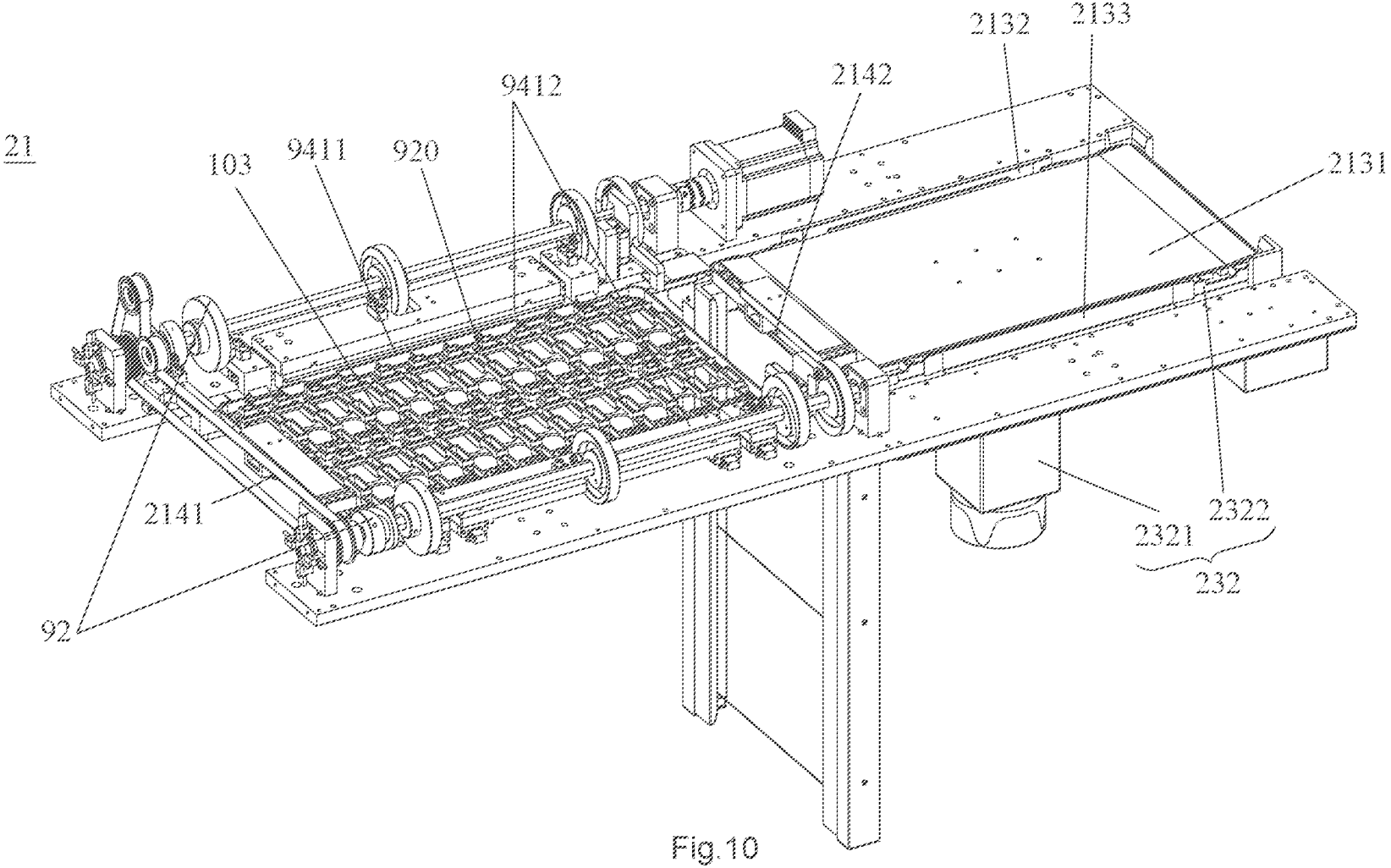
FIG. 10 is a partial perspective view of the loading mechanism according to one embodiment of the present invention.

As shown in FIG. 1, the loading mechanism 200 includes a feeding device 21 for feeding to the loading portion 11 and a loading conveying mechanism 22. Referring to FIGS. 9 and 10, the feeding device 21 includes a feeding box 212 and a transfer mechanism (2141, 2142). The separation mechanism 215 is installed in the feeding box 212.

Figure 8:
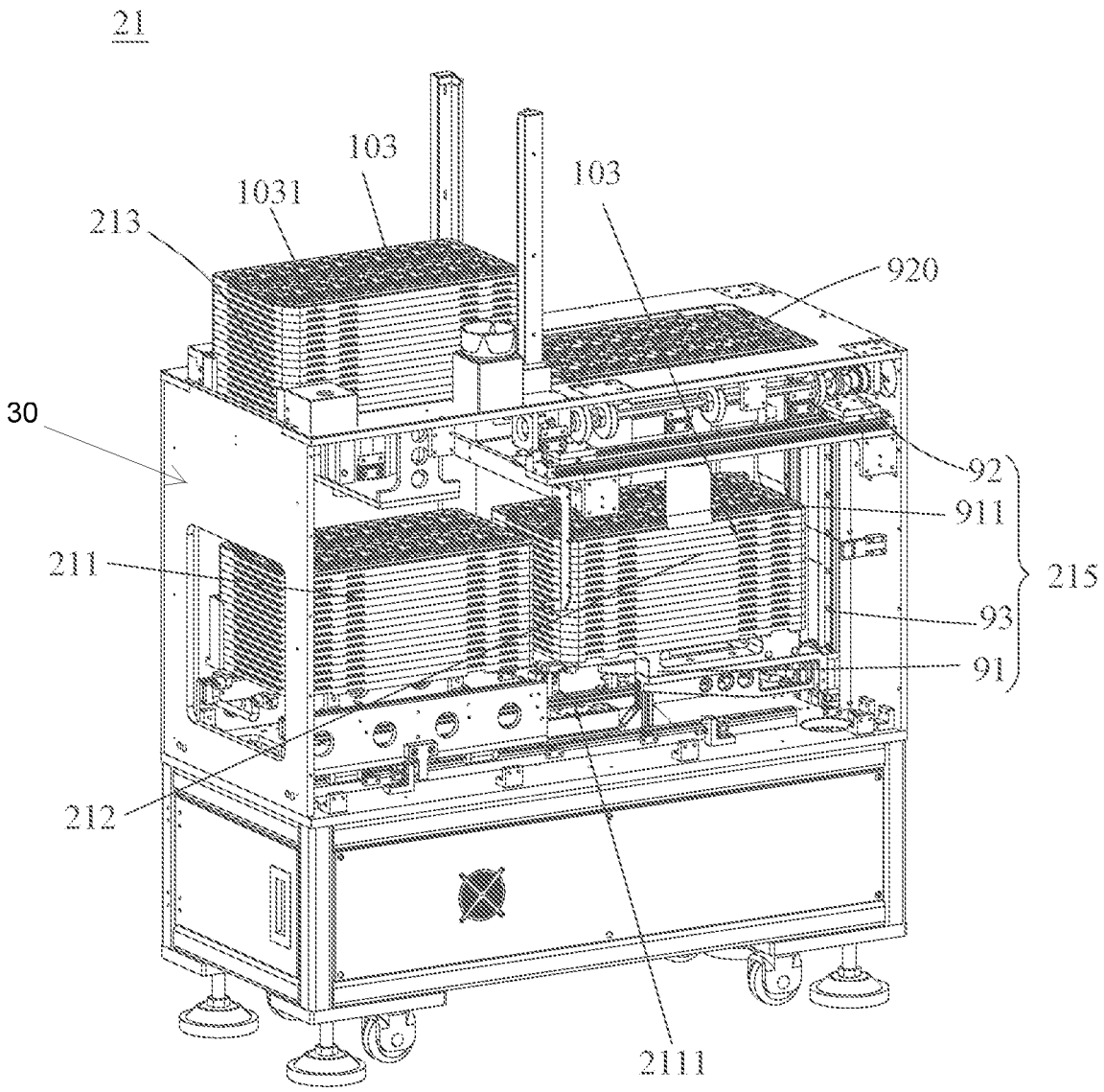
FIG. 8 is a perspective view of a loading mechanism according to one embodiment of the present invention.

Referring to FIGS. 8 and 9, the separation mechanism 215 includes a material shelf 91, a clamping assembly 92, and a lifting assembly 93. Furthermore, the material shelf 91 has a material area 911 for holding material trays 103. The clamping assembly 92 is located at an upper opening of the feeding box 212. Furthermore, the clamping assembly 92 cooperating with the lifting assembly 93 is arranged for separating the material tray 103 on the material shelf 91 in the feeding box 212. In this embodiment, the material tray 103 is used for holding the memory 102. Therefore, the clamping assembly 92 above the feeding box 212 is also formed with a feeding area. The loading conveying mechanism 22 on the production line can directly take the memory 102 from the feeding area. After taking the memory 102, the material tray 103 can be removed from the clamping assembly 92 by the transfer mechanism (2141, 2142).

Figure 11:
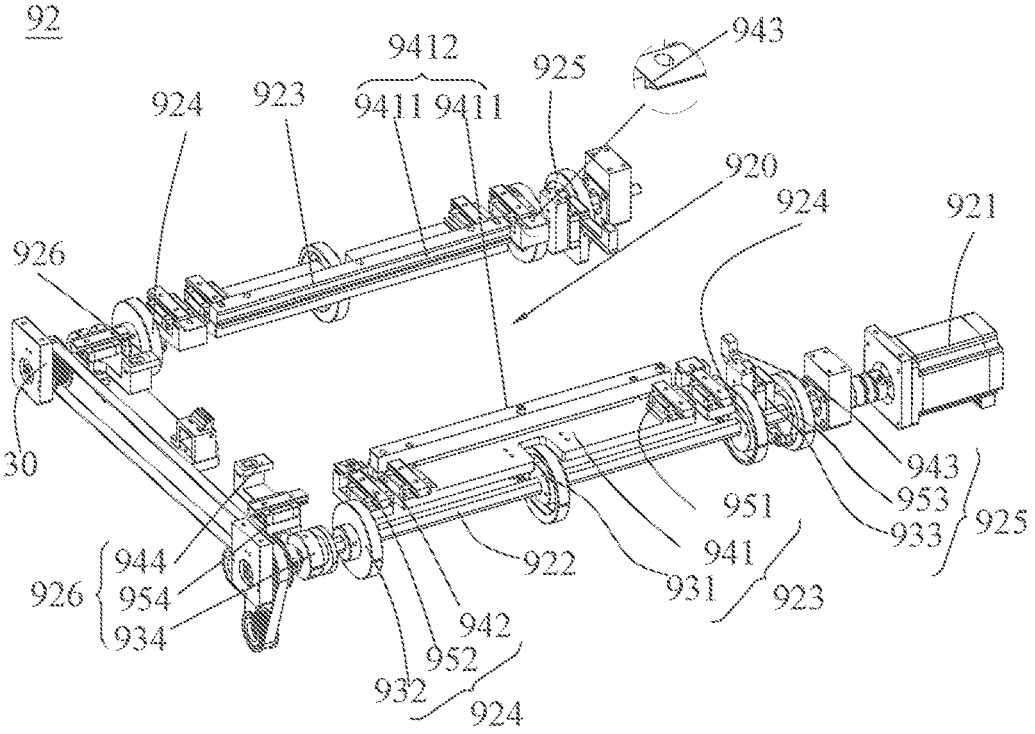
FIG. 11 is a perspective view of a clamping assembly according to one embodiment of the present invention.
Figure 12:
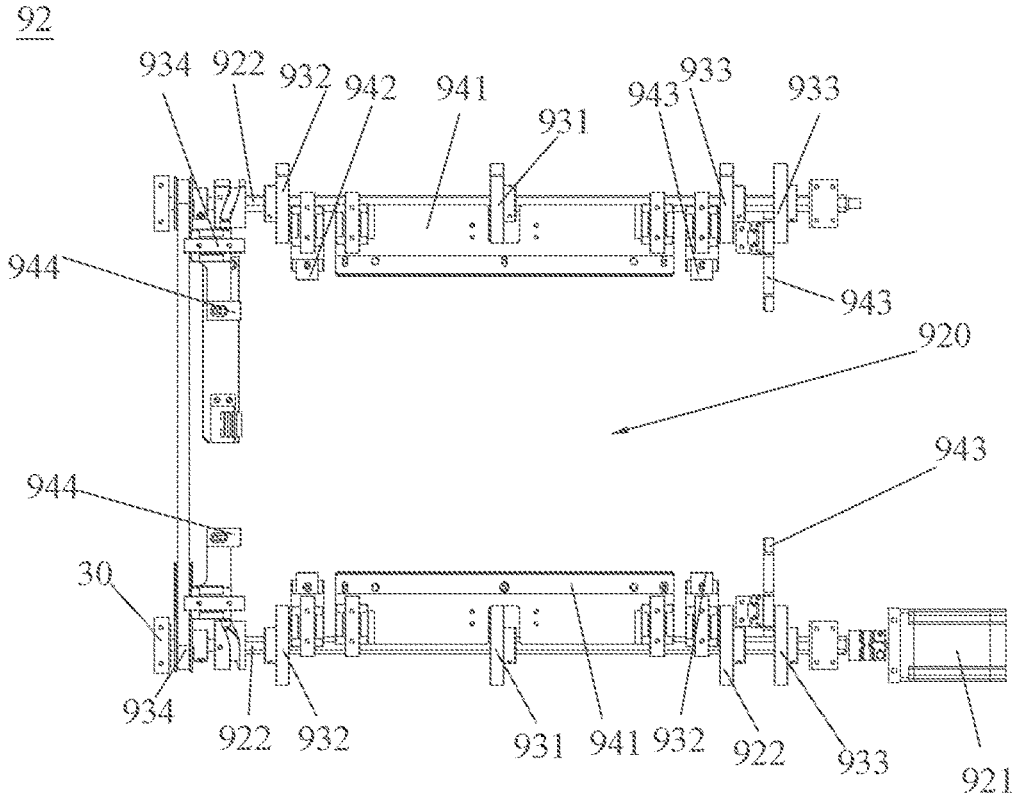
FIG. 12 is a bottom plan view of the clamping assembly according to one embodiment of the present invention.
Figure 13:
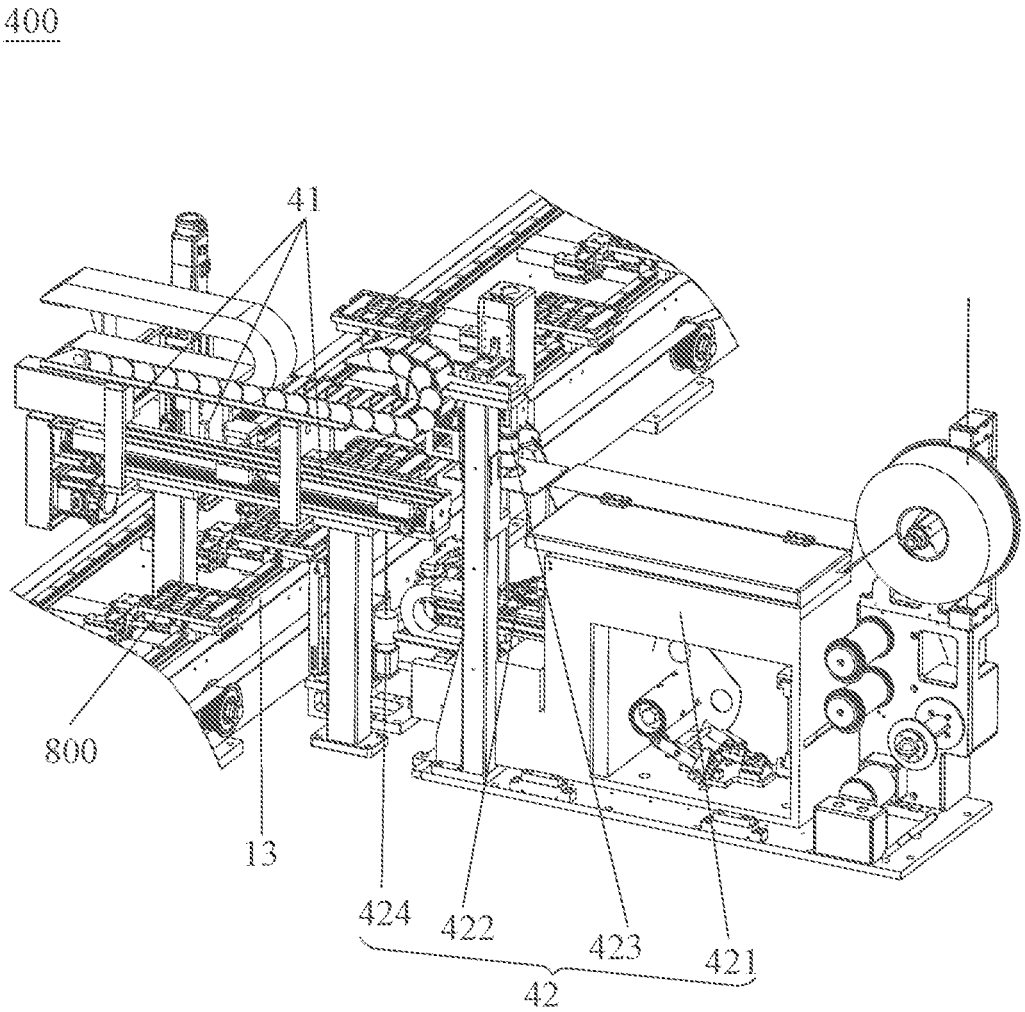
FIG. 13 is a partial perspective view of an automatic labeling mechanism according to one embodiment of the present invention.

Referring to FIGS. 11 and 12, the clamping assembly 92 includes a driving motor 921 mounted on the body frame 30, two rotating shafts 922 driven by the driving motor 921, and the two main clamping portions 923 respectively mounted on the two rotating shafts 922. A separation area 920 is formed between the two rotating shafts 922 and located above the material area 911. Furthermore, the main clamping portion 923 includes a main cam 931 mounted on the rotating shaft 922, a main clamping block 941 following the main cam 931, and a first guide rail 951 horizontally disposed and connected to the body frame 30. The two main cams 931 are driven by the rotating shafts 922 to rotate, and the main clamping block 941 is slidably connected to the first guide rail 951. The main clamping block 941 is driven by the main cam 931 to stretch into or withdraw from the separation area 920 to clamp or release the material tray 103. The rotating shaft 922 is rotatable between an initial station and a clamping station. As shown in FIG. 13, the main clamping blocks 941 are driven by the main cams 931 to withdraw to release the material tray 103 when the rotating shafts 922 are rotated to the initial station. Furthermore, the main clamping blocks 941 are driven by the main cams 931 to stretch out at the clamping station when the rotating shafts 922 are rotated between the initial station and the clamping station. Or, the main clamping block 941 are driven by the main cams 931 to withdraw at the initial station when the rotating shafts 922 are rotated between the clamping station and the initial station. Specifically, the driving motor 921 is a stepping motor. Of course, the lifting assembly 93 may also be connected to the clamping assembly 92, and the clamping assembly 92 is controlled to lift and lower to separate relatively the clamping assembly 92 and the material shelf 91.

In this embodiment, the lifting assembly 93 is connected to the material shelf 91 for lifting or lowering the material shelf 91, so that the clamping assembly 92 and the material shelf 91 move relatively to each other. Of course, the lifting assembly 93 can also be connected to the clamping assembly 92 to lifting or lowering the clamping assembly 92.

Preferably, as shown in FIG. 11, a sliding groove 9411 is defined on the main clamping block 941 for the material tray 103 sliding. A sliding rail 9412 is formed by the sliding grooves 9411 of the two main clamping blocks for the material tray 103 sliding. In this embodiment, cross-section of the sliding groove 9411 is "U" shaped.

Of course, the first guide rail 951 of the main clamping portion 923 uses other guiding element, such as an inclined curved track. Or the guiding element may be removed, and the main clamping block 941 is directly configured on the main cam 931. Alternatively, the guiding element is connected to the main cam 931 by a spring member. At this time, cross section of the sliding groove 9411 is "L" shaped.

Specifically, the material shelf 91 is lifted by the lifting assembly 93 before the initial station, so that the material tray 103 on the top of the material area 911 is moved to the separation area 920 at the initial station; after the clamping station, the material shelf 91 is descended, thereby separating the material tray 103 on the top of the material area 911 from the material shelf 91.

Referring to FIGS. 10-12, the clamping assembly 92 further includes a holding assembly, which includes two holding portions 924 respectively mounted on the two rotating shafts 922. The holding portion 924 includes a holding cam 932 mounted on the rotating shaft 922, a holding block 942 following the holding cam 932, and a third guide rail 952 connected to the body frame 30 and horizontally arranged. Specifically, the two holding cams 932 are driven by two rotating shafts 922 to rotate, and the holding cam 932 is slidably connected to the third guide rail 952. The holding blocks 942 are driven by the holding cam 932 to stretch into or withdraw from the separation area 920 to clamp or release the material tray 103.

Alignment grooves 1031 are formed on the left and right sides of the material tray 103. The holding block 942 is arranged for cooperating with the alignment groove 1031 and inserting into the alignment groove 1031 to hold the material tray 103. Preferably, the holding block 942 is wedge-shaped. Preferably, the number of the holding portions 924 is four. Two holding portions 924 are in a group and located on the front and rear sides of the main clamping portion 923. Of course, the third guide rail 952 of the holding portion 924 also uses other guiding element, such as an inclined curved track. Or the guiding element may be removed, and the holding block 942 is directly formed on the holding cam 932. Alternatively, the guiding element is connected to the holding cam 932 by a spring member.

Specifically, the rotating shafts 922 are rotatable among the initial station, a holding station, the clamping station and an unloading station. Furthermore, the main cam, the holding cam, and the front and the rear cams are distributed along a periphery of the rotating shaft 922 at a certain angle. Furthermore, the holding blocks 942 are withdrawn, thereby releasing the holding portions 924 when the rotating shafts 922 are rotated to the initial station. Furthermore, the holding blocks 942 are driven by the holding cams 932 to stretch to hold the material tray 103 at the holding station when the rotating shafts 922 are rotated between the initial station and the holding station. Furthermore, when the rotating shafts 922 are rotated between the holding station and the clamping station, the main clamping blocks 941 are driven by the main cams 931 to stretch to clamp the material trays 103 before the holding blocks 942 are withdrawn completely. Also, the holding blocks 942 are driven by the holding cams 932 to withdraw and release the material tray 103 at the unloading station when the rotating shafts 922 are rotated between the clamping station and the unloading station. The lifting assembly 93 is arranged for controlling the material shelf 91 to rise at the initial station, so that the material tray 103 on the top of the material area 911 is moved to the separation area 920. Furthermore, the material shelf 91 is descended at the holding station, thereby separating the material tray 103 on the top of the material area 911 from the material shelf 91.

Referring to FIGS. 10-12, the clamping assembly 92 further includes a subordinate clamping assembly (925, 926) including a front clamping portion 925 and a rear clamping portion 926. Specifically, the front clamping portion 925 is located on the front side of the separation area 920, and the rear clamping portion 926 is located on the rear side of the separation area 920. The front clamping portion 925 includes a front cam 933 mounted on the rotating shaft 922, a front clamping block 943 following the front cam 933, and a fourth guide rail 953 connected to the body frame 30 and vertically arranged. Specifically, the two front cams 933 are driven by the two rotating shafts 922 to rotate, and the front cam 933 is slidably connected to the fourth guide rail 953. The front clamping blocks 943 are driven by the front cams 933 to stretch out and withdraw from the front edge of the separation area 920. The rear clamping portion 926 includes a rear cam 934 mounted on the rotating shaft 922, a rear clamping block 944 following the rear cam 934, and a guiding member 954 connected to the body frame 30 and vertically arranged. Furthermore, the guiding member 954 is a fifth guide rail. Specifically, the two rear cams 934 are driven by the two rotating shafts 922 to rotate, and the rear cams 934 are slidably connected to the fifth guide rail 954. The rear clamping blocks 944 are driven by the rear cams 934 to stretch out and withdraw from the rear edge of the separation area 920. Moreover, the front clamping block 943 and the rear clamping block 944 are respectively driven by the front cam 933 and the rear cam 934 to stretch out or withdraw.

Referring to FIGS. 10 and 11, the transfer mechanism (2141, 2142) includes dial blocks (2141, 2142) rotatably installed on the body frame 30 and located on front and rear sides of the separation area 920. At the unloading station, the dial blocks (2141, 2142) are arranged for rotating and toggling the material tray 103 to slide along the sliding rail 9412 until the material tray 103 is separated from the separation area 920 and conveyed the stacking table 231.

Specifically, the number of the front clamping portion 925 is two, and the two front clamping portions 925 are mounted on the rotating shafts 922; and the number of the rear clamping portion 926 is two, and the two rear clamping portions 926 are mounted on the rotating shafts 922.

In this embodiment, the rotating shafts 922 are rotated among the initial station, the holding station, the clamping station and the unloading station. Specifically, the front clamping block 943 and the rear clamping block 944 are respectively driven by the front cam 933 and the rear cam 934 to withdraw to release the material tray 103 when the rotating shafts 922 are rotated to the initial station. Furthermore, the front clamping blocks 943 are driven by the front cams 933 to stretch to the front edge of the separation area 920 when the rotating shafts 922 are rotated from the initial station to the holding station. Furthermore, the rear clamping blocks 944 are driven by the rear cams 934 to stretch to the rear edge of the separation area 920 to clamp the material tray 103 when the rotating shafts 922 are rotated from the holding station to the clamping station. Furthermore, the front clamping block 943 and the rear clamping block 944 are driven by the front cam 933 and the rear cam 934 to withdraw to release the material tray 103 when the rotating shafts 922 are rotated from the clamping station to the unloading station.

Of course, the fourth guide rail 953 also uses other guiding element, such as an inclined curved track. Or the guiding element may be removed, and the holding block 942 is directly formed on the holding cam 932. Besides, the fourth guide rail 953 is not limited to the vertical arrangement.

Referring to FIGS. 8-10, the feeding device 21 further includes a stacking assembly 213, which includes a stacking table 231, a lifting mechanism 232, and a second guide rail 2131 communicating with the sliding rail 9412. The second guide rail 2131 is formed by the bottom surface of the stacking table 231 and two side walls 2132, 2133. The transfer mechanism (2141, 2142) is located at an upper opening of the feeding box 212 and drives the material tray 103 on the sliding rail 9412 to move to the stacking table 231. The lifting mechanism 232 includes another drive mechanism 2321 and an ejecting block 2322. The ejecting blocks 2322 are positioned on both sides of the stacking table 231 and face edge of the material tray 103. When the transfer mechanism (2141, 2142) is operated, the ejecting block 2322 lifts up the material body 103 on the stacking table 231.

Preferably, as shown in FIG. 8, the feeding device 21 further includes a storage box 211, and a material transfer track 2111 communicated with the material shelf 91 is installed in the storage box 211. Furthermore, the material transfer track 2111 is arranged for carrying the material trays 103 and conveying them to the material shelf 91. The stacking table 231 is located at a top of the storage box 211.

Referring to FIGS. 10 and 11, the transfer mechanism (2141, 2142) includes dial blocks (2141, 2142) rotatably installed on the body frame 10 and located on front and rear sides of the separation area 920. At the unloading station, the dial blocks (2141, 2142) are arranged for rotating and toggling the material tray 103 to slide along the sliding rail 9412 until the material tray 103 is separated from the separation area 920 and conveyed the stacking table 231.

Figure 1C:
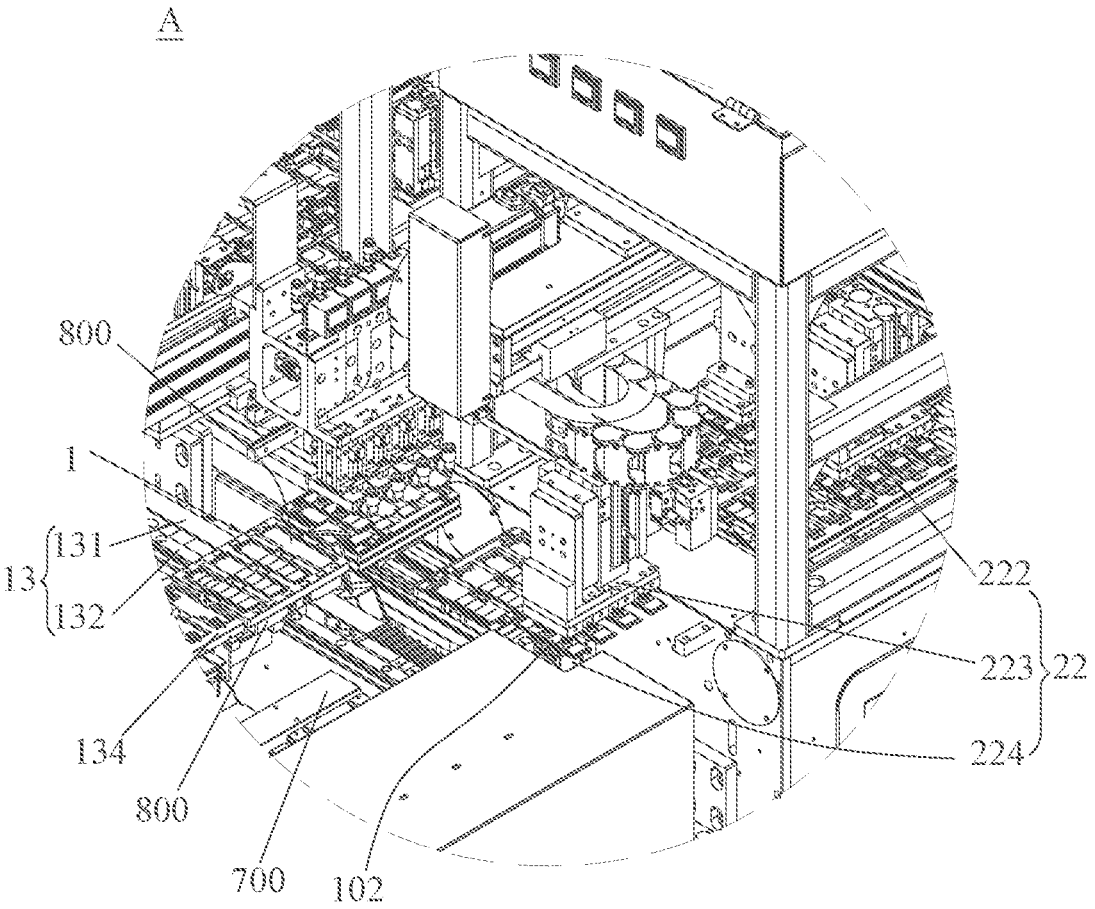
FIG. 1*c* is a partial enlarged view of portion A in FIG. 1*a;*

Referring to FIGS. 1*a* and 1*c*, the loading conveying mechanism 22 includes a first conveying mechanism having a first robot 222, a second conveying mechanism having a second robot 223, and a temporary storage area 224. Specifically, the first robot 222 are driven by the first conveying mechanism from the feeding zone to the temporary storage area 224, the second robot 223 are driven by the second conveying mechanism to move from the temporary storage area 224 to the loading port 11, and then the first robot 222 and the second robot 223 are arranged for respectively grabbing or releasing the memory 102. In fact, the feeding area is the separation area 920. Moreover, in the clamping station, the memory 102 is clamped by the loading conveying mechanism 22 from the feeding area and transferred to the fixture 800 at the loading port 11.

The feeding device 21 according to this embodiment above is operated at four stations of the clamping assembly, as follows:

(1) When the clamping assembly 92 is in the initial state, the main clamping block 941, the holding block 942, the front clamping block 943, and the rear clamping block 944 are withdrawn from the separation area 920; and the main clamping portion 923, the holding portion 924 and the subordinate clamping assembly (925, 926) are released.

(2) The material shelf 91 is lifted by the lifting assembly 93, so that the material tray 103 on the top of the material area 911 is moved upward to the separation area 920. The rotating shafts 922 are rotated, and the holding blocks 942 are driven by the holding cam 932 to stretch into the separation area 920. When the rotating shafts 922 are rotated by 90 degrees from the initial position, the holding blocks 942 on the left and right sides of the separation area 920 are respectively inserted into the alignment grooves 1031 on both sides of the material tray 103. The front clamping blocks 943 are driven by the front cams 933 to extend upwards to the front edge of the separation area 920. At this time, the front clamping blocks 943 are close to or contact the front side of the material tray 103. It is at the holding station at this time.

(3) The material shelf 91 is driven to descend by the lifting assembly 93, so that the material tray 103 on the top of the material shelf 91 is separated from other material trays. The separated material tray 103 is held on the holding block 942.

(4) The rotating shafts 922 continue to be rotated, and the main clamping blocks 941 are driven by the main cams 931 to stretch into the separation area 920 and insert into the material tray 103 so that the material tray 103 is positioned and adapted for the sliding rail 9412. After the material tray 103 is positioned, the rotating shafts 922 continue to be rotated. The holding blocks 942 are driven by the holding cams 932 to withdraw. When the rotating shafts 922 are rotated by 180 degrees from the initial position, the holding blocks 942 are respectively exited from the alignment grooves 1031 to release the material tray. At the same time, the rear clamping blocks 944 are driven by the rear cams 934 to extend towards the rear edge of the separation area 920. Then the material tray 103 is pushed by the rear clamping blocks 94 to approaching the front clamping blocks 943, and the material tray 103 is clamped by the subordinate clamping assembly (925, 926). It is at the clamping station at this time. The memory 102 on the material tray 103 is clamped by the loading conveying mechanism 22 from the feeding area and transferred the memory 102 to the fixture 800 at the loading port 11.

(5) After the memories on the material tray 103 finish being loaded, the rotating shafts 922 continue to be rotated. The front clamping blocks 943 are driven by the front cams 933 to withdraw. At this time, the front clamping blocks 943 are away from the front side of the material tray 103, and the rear clamping blocks 934 are driven by the rear cams 934 to be away from the rear side of the material tray 103. When the rotating shafts 922 are rotated by 270 degrees from the initial position, the subordinate clamping assembly (925, 926) is released. It is at the unloading station at this time.

(6) The dial blocks (2141, 2142) are rotated back and forth to toggle the material tray 103 to slide along the sliding rail 9412 until it is separated from the separation area 920 and enters the stacking table 231.

(7) After the material tray 103 is separated from the separation area 920, the rotating shafts 922 continue to be rotated. The main clamping blocks 941 are driven by the main cams 931 to withdraw from the separation area 920. The main clamping portion 923 is released, and it is at the initial station.

Figure 6:
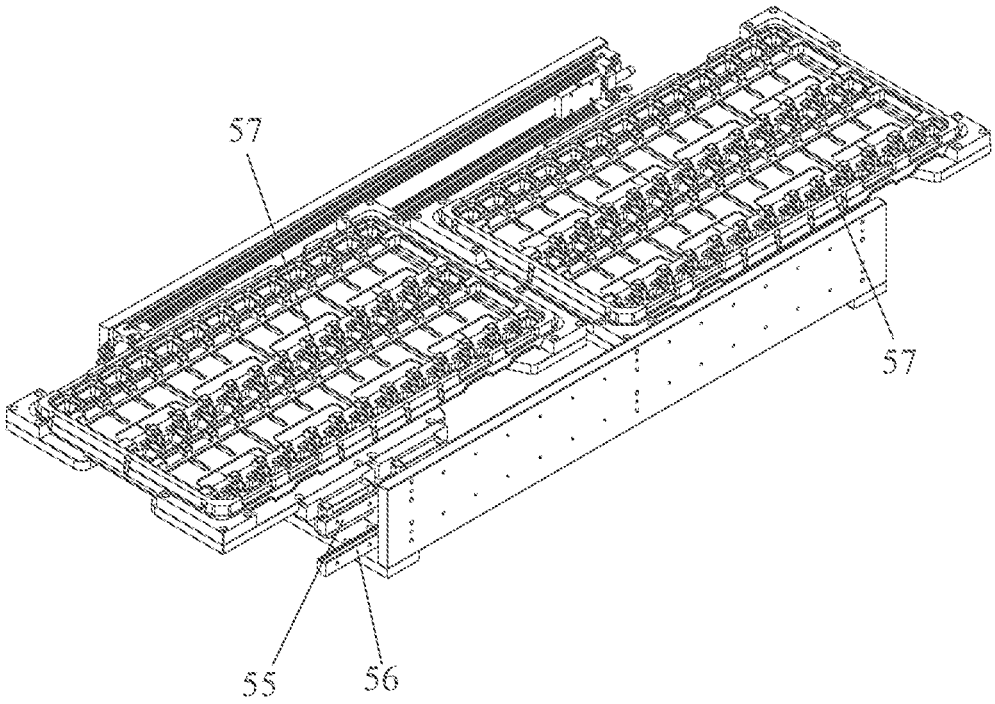
FIG. 6 is a perspective view of a recycling box of a defective product recycling mechanism according to one embodiment of the present invention.
Figure 7:
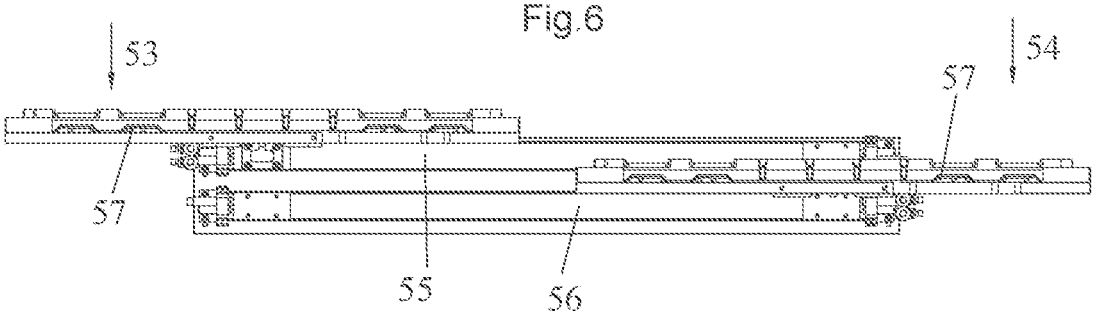
FIG. 7 is a side elevation view of the recycling box of the defective product recycling mechanism according to one embodiment of the present invention.

Furthermore, both the first recycling mechanism 300 and the second recycling mechanism 500 are a defective product recycling mechanism for recycling defective memory, as shown in FIGS. 6 and 7. Specifically, the defective product recycling mechanism includes a recycling box 51 and a recycling transmission portion 52. Furthermore, the recycling box 51 is provided with a defective product placement area 53, a defective product removal area 54, a first conveying rail 55 and a second conveying rail 56 arranged between the defective product placement area 53 and the defective product removal area 54 and disposed in parallel. Furthermore, the first conveying rail 55 and the second conveying rail 56 are respectively slidably mounted with a recycling container 57 for holding the memory 102.

More specifically, after the memories on the recycling container 57 are taken away in the defective product removal area 54 (the memories can be discharged by an external defective product unloading device), the first conveying rail 55 or the second conveying rail 56 is driven by a drive mechanism to transport the empty recycling container 57 to the defective product placement area 53. Subsequently, the defective memory is removed by the recycling transmission portion 52 removes from the fixture 800, transported it to the defective product placement area 53, and placed into the recycling container 57 at the defective product placement area 53. After the recycling container 57 is filled with the defective memories 102, the recycling container 57 is driven by the drive mechanism to move to the defective product removal area 54; then the defective memories are unloaded in the defective product removal area 54. Therefore, the two recycling containers 57 are alternately operated by two parallel conveying rails, so that defective memories can be continuously replaced or unloaded. To be specific, the defective memories are clamped by the recycling transmission portion 52 on the processing position 2 and the processing position 9 on the production line, and transferred the defective memories to the defective product placement area 53 for unloading. In this embodiment, the recycling container 57 is the material tray 103.

Figure 3:
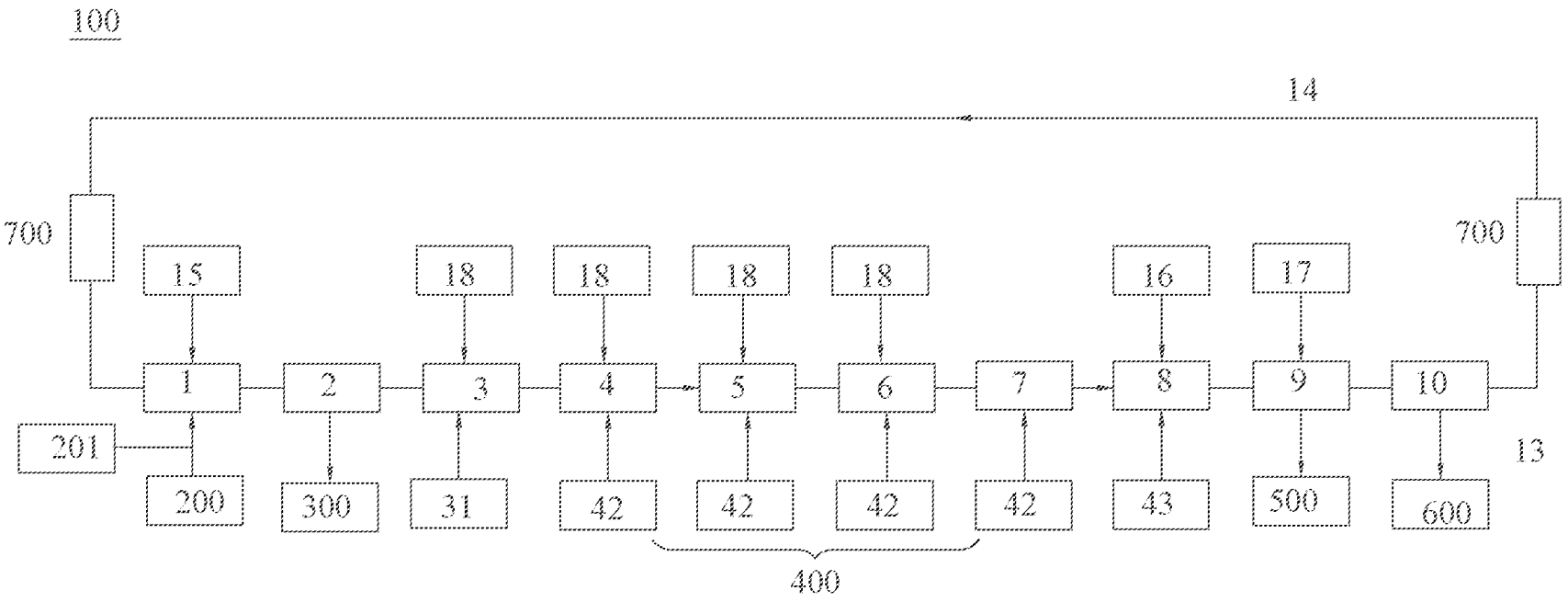
FIG. 3 is a schematic diagram of the automatic labeling production line for solid state disk according to one embodiment of the present invention.

Referring to FIG. 3, each of the fixtures 800 has four placement grooves 811 for placing memories 102. Specifically, the automatic labeling mechanism 400 includes four labeling positions 4-7 corresponding to the four placement grooves 811, four label conveying mechanisms 41 corresponding to the four labeling positions respectively, and a rolling mechanism 43 disposed behind the labeling positions 4-7. Each of the labeling positions is provided with the third fixture scanning mechanism 18 for scanning the fixture code, and an automatic label printer 42 for printing a memory label is arranged at a position corresponding to each of the labeling positions. Each of the label conveying mechanisms 41 respectively is arranged for transferring memory labels printed by the corresponding automatic label printer 442 to the labeling position, and the rolling mechanism 43 is arranged for rolling the memory labels on the four memories to stick the memory labels. The third fixture scanning mechanism 18 corresponding to each labeling position is disposed at a previous labeling position on production conveyor belt 13.

Furthermore, when the corresponding third fixture scanning mechanism 18 is arranged for scanning the fixture code, the automatic label printer 42 is arranged for obtaining the original code of the memory 102 to be labeled and printing the corresponding memory label according to the original code of the memory 102.

Figure 14:
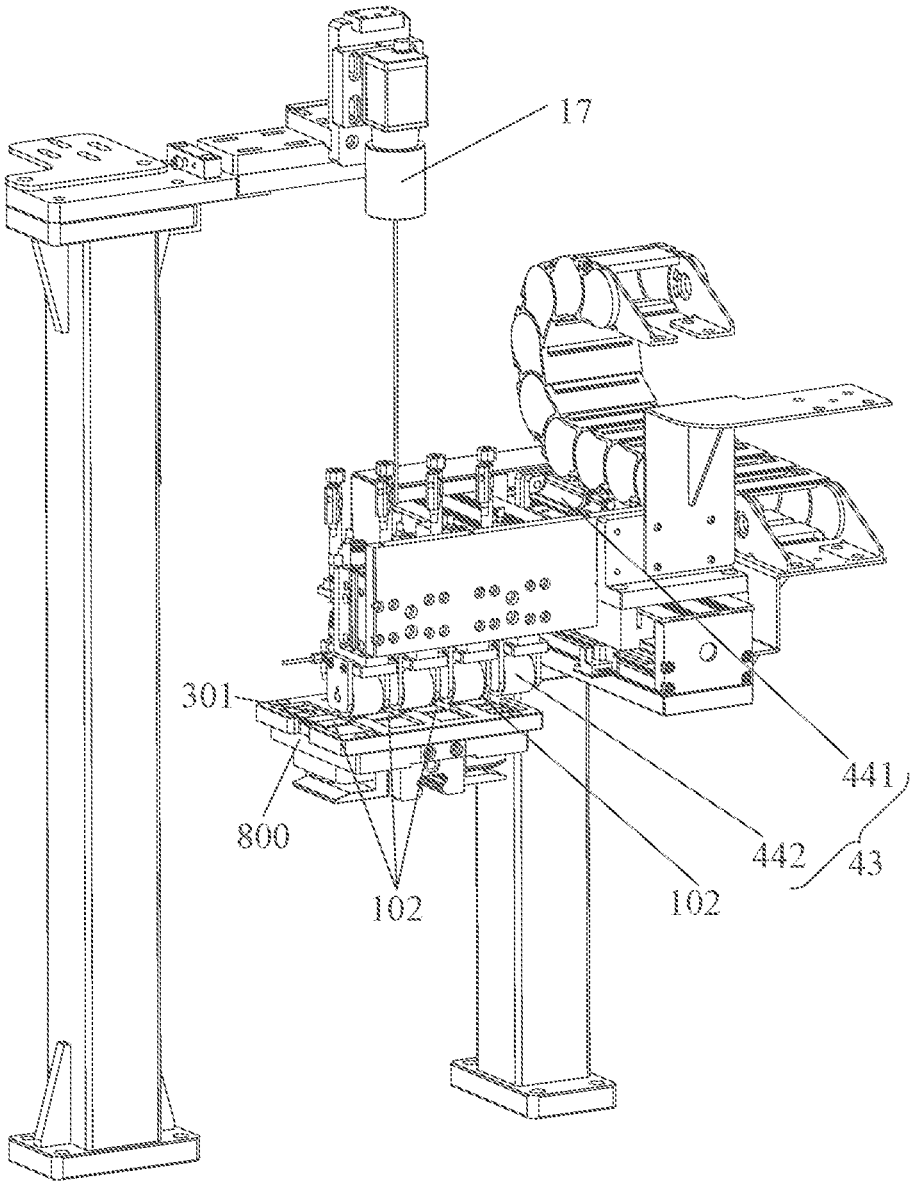
FIG. 14 is a perspective view of a visual inspection mechanism and a rolling mechanism according to one embodiment of the present invention.

Referring to FIG. 14, the rolling mechanism 43 includes a rolling drive mechanism 441 and four rolling wheels 442 driven by the rolling drive mechanism 441. Specifically, the four rolling wheels 442 are driven by the rolling drive mechanism 441 into the corresponding placement grooves 811 and used for rolling the memory labels 301 of the four memories 102 on the fixture 800 to stick the memory labels 301. Specifically, the rolling wheel 442 is a roller.

Figure 15:
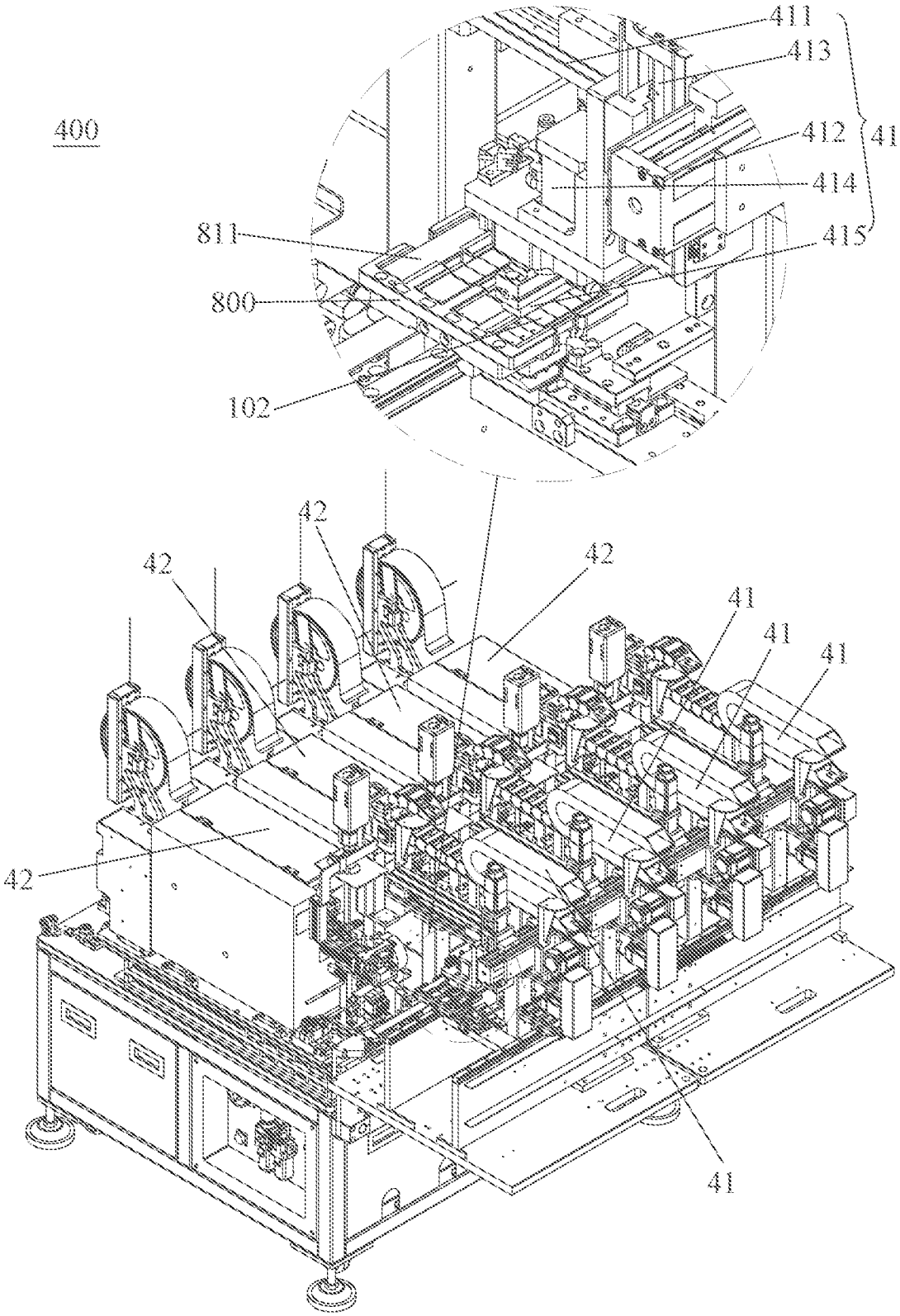
FIG. 15 is a perspective view of the automatic labeling mechanism viewed from another angle according to one embodiment of the present invention.

Referring to FIG. 15, the label conveying mechanism 41 includes an X-axis robot arm 411, a Y-axis robot arm 412 slidably connected to the X-axis robot arm 411, a Z-axis robot arm 413 slidably connected to the Y-axis robot arm 412, a rotary cylinder 414 slidably connected to the Z-axis robot arm 413, and a gripping portion 415 connected to the rotary cylinder 414. Furthermore, the X-axis robot arm 411, the Y-axis robot arm 412, and the Z-axis robot arm 413 are arranged for respectively drive the gripping portion 415 in the X-axis direction, the Y-axis direction, or the Z-axis direction; and the gripping portion 415 is driven by the rotary cylinder 414 to rotate in the horizontal plane, and the gripping portion 415 is used for gripping the memory label.

Referring to FIGS. 13 and 15, the automatic label printer 42 includes a label printing unit 421, a label output table 422, a label inspection unit 423, and a label position confirmation unit 424. Specifically, the label printing unit 421 is arranged for printing a memory label and then outputting the memory label to the label output table 422. The label inspection unit 423 is arranged for checking whether the memory label at the label output table 422 is printed incorrectly. If the memory label is printed incorrectly, the label printing unit 421 is arranged for reprinting and recycling the wrong memory label. The label conveying mechanism 41 is arranged for gripping the memory label and conveying the memory label to a label position confirmation unit 424; subsequently the label position confirmation unit 424 is used for confirming a position of the memory label on the robot of the label conveying mechanism 41. Furthermore, the label conveying mechanism 41 is arranged for conveying the memory label from the label position confirmation unit 424 to the labeling position and adjusting an angle and a position of the robot at the labeling position according to a position of the memory label on the robot of the label conveying mechanism 41, so that the memory label is faced to a position of the memory to be labeled on the fixture 800.

Referring to FIGS. 3 and 4, retaining grooves 84 are respectively formed on left and right side walls of the fixture 800. Furthermore, the processing positions 1-10 on the production conveyor belt 13 are respectively provided with the corresponding retaining cylinder 134. Furthermore, an end of the retaining cylinder 134 is provided with a positioning block 135 which can extend into the retaining groove 84, and the retaining cylinder 134 is arranged for controlling the positioning blocks 135 to extend out to limit the fixture 800.

Referring to FIGS. 2 and 3, in this embodiment, ten processing positions 1-10 are set on the production conveyor belt 13, and the processing positions 4-7 are the labeling positions. Referring to FIG. 3, the loading mechanism 200 and the first fixture scanning mechanism 15 are located at the processing position 1; the first recycling mechanism 300 is located at the processing position 2; one third fixture scanning mechanism 18 of the automatic labeling mechanism 400 is located at the processing position 3; one third fixture scanning mechanism 18 of the automatic labeling mechanism 400 and the first automatic label printer 42 are located at the processing position 4; one third fixture scanning mechanism 18 of the automatic labeling mechanism 400 and the second automatic label printer 42 are located at the processing position 5; one third fixture scanning mechanism 18 and the third automatic label printer 42 of the automatic labeling mechanism 400 are located at the processing position 6; the fourth automatic label printer 42 of the automatic labeling mechanism 400 is located the processing position 7; the rolling mechanism 43 and the visual inspection mechanism 16 are located at the processing position 8; the second fixture scanning mechanism 17 and the second recycling mechanism 500 are located at the processing position 9; and the unloading mechanism 600 is located at the processing position 10. Among them, a static elimination device 31 is further disposed at the processing position 3 to remove static electricity on the memory for subsequent labeling.

Referring to FIGS. 1*a* to 3, the working process of the automatic labeling production line for solid state disk 100 will be described. To be specific, when the fixture 800 is conveyed to the processing position 1 (the loading port 11) from the front end of the production conveyor belt 13, the fixture 800 is positioned by the retaining cylinder 134, at which time the fixture 800 does not move along with the production conveyor belt 13, instead, the first fixture scanning mechanism 15 scans and records the fixture code of the fixture 800. The loading mechanism 200 loads, that is, the loading mechanism 200 moves the memory 102 to the fixture 800 at the processing position 1. During the conveying process, the product scanning mechanism 201 disposed on a conveying path of the loading mechanism 200 scans the original code of the memory 102 conveyed to the loading port 11 and determines whether the original code is incorrect. For instance, the original code is fuzzy, missing, unreadable, etc. If it is wrong, it is marked as a first defective memory; and if there is no error, it is marked as a qualified or not marked. The original code information and the mark information obtained by the product scanning mechanism 201 are sent to the first fixture scanning mechanism 15. The first fixture scanning mechanism 15 scans the fixture code and records the original code of the memory 102 carried thereon, the corresponding fixture code, and the mark information of the first defective memory. Upon finishing operating on the processing position 1, the retaining cylinder 134 is reset to unlock the fixture 800, and the fixture 800 continues to be moved along with the production conveyor belt 13.

Subsequently, the fixture 800 continues to be moved to the processing position 2. If the first defective memory is carried on the fixture 800, the retaining cylinder 134 at the processing position 2 is controlled to position the fixture 800, and the first recycling mechanism 300 is controlled to clamp the first defective memory on the fixture 800 and transport it out. If there is no defective memory on the fixture 800, the device at the processing position 2 does not operate. Upon finishing operating on the processing position 2, the retaining cylinder 134 is reset to unlock the fixture 800, and the fixture 800 continues to be moved along with the production conveyor belt 13.

Subsequently, the fixture 800 continues to be moved to the processing position 3. Specifically, the fixture 800 is positioned by the retaining cylinder 134, and then the static elimination device 31 removes static electricity on the memory 102, and the third fixture scanning mechanism 18 scans the fixture code to determine the memory 102 carried on the fixture 800. Upon finishing operating on the processing position 3, the retaining cylinder 134 is reset to unlock the fixture 800, and the fixture 800 continues to be moved along with the production conveyor belt 13.

Subsequently, the fixture 800 continues to be moved to the processing position 4. Specifically, the fixture 800 is positioned by the retaining cylinder 134, and the third fixture scanning mechanism 18 scans the fixture code on the processing position 4 to determine the memory 102 carried on the fixture 800. Upon finishing operating on the processing position 4, the retaining cylinder 134 is reset to unlock the fixture 800, and the fixture 800 continues to be moved along with the production conveyor belt 13.

Subsequently, the fixture 800 continues to be moved to the processing position 5. Specifically, the fixture 800 is positioned by the retaining cylinder 134, and the third fixture scanning mechanism 18 scans the fixture code at the processing position 4 to determine the memory 102 carried on the fixture 800. The automatic code printer 42 prints the memory label, and the label conveying mechanism 41 transports the memory label to the fixture 800 on the processing position 5 for labeling. Upon finishing operating on the processing position 5, the retaining cylinder 134 is reset to unlock the fixture 800, and the fixture 800 continues to be moved along with the production conveyor belt 13.

Subsequently, the fixture 800 continues to be moved to the processing position 6. Specifically, the fixture 800 is positioned by the retaining cylinder 134, and the third fixture scanning mechanism 18 scans the fixture code at the processing position 4 to determine the memory 102 carried on the fixture 800. The automatic code printer 42 prints the memory label, and the label conveying mechanism 41 transports the memory label to the fixture 800 on the processing position 6 for labeling. Upon finishing operating on the processing position 6, the retaining cylinder 134 is reset to unlock the fixture 800, and the fixture 800 continues to be moved along with the production conveyor belt 13.

Subsequently, the fixture 800 continues to be moved to the processing position 7. Specifically, the fixture 800 is positioned by the retaining cylinder 134, the automatic code printer 42 prints the memory label, and the label conveying mechanism 41 transports the memory label to the fixture 800 on the processing position 7 for labeling. Upon finishing operating on the processing position 7, the retaining cylinder 134 is reset to unlock the fixture 800, and the fixture 800 continues to be moved along with the production conveyor belt 13.

Subsequently, the fixture 800 continues to be moved to the processing position 8. Specifically, the fixture 800 is positioned by the retaining cylinder 134, and the visual inspection mechanism 16 detects whether the memory label is mislabeled. For example, the memory label is printed incorrectly, the memory label is pasted incorrectly, or the wrong label is pasted, etc. If it is wrong, it is marked as a second defective memory; and if there is no error, it is marked as a qualified or not marked. Preferably, the rolling mechanism 43 rolls the memory label on the memory 102 so that the memory label is firmly attached to the memory 102. Upon finishing operating on the processing position 8, the retaining cylinder 134 is reset to unlock the fixture 800, and the fixture 800 continues to be moved along with the production conveyor belt 13.

Subsequently, the fixture 800 continues to be moved to the processing position 9. Specifically, the fixture 800 is positioned by the retaining cylinder 134, and the second fixture scanning mechanism 17 scans and identify the memory label to confirm whether the second defective memory is carried on the fixture 800. If the second defective memory is carried on the fixture 800, the second recycling mechanism 500 will be controlled to recycle the second defective memory. Or, if there is no second defective memory on the fixture 800, the second recycling mechanism 500 will not operate. Upon finishing operating on the processing position 9, the retaining cylinder 134 is reset to unlock the fixture 800, and the fixture 800 continues to be moved along with the production conveyor belt 13.

Subsequently, the fixture 800 continues to be moved to the processing position 10. Specifically, the fixture 800 is positioned by the retaining cylinder 134, and the unloading mechanism 600 unloads the memory 102 from the fixture 800. Upon finishing operating on the processing position 10, the retaining cylinder 134 is reset to unlock the fixture 800, and the fixture 800 continues to be moved along with the production conveyor belt 13.

To be specific, the fixture 800 continues to be moved until it moves out of the end of the production conveyor belt 13. Driven by the belt body 131 of the production conveyor belt 13, the fixture 800 slides on the fixture sliding rail 133 along the bearing rail 731 of the fixture transfer mechanism 700 to the bearing slider 73. The return drive portion 71 operates to push the bearing slider 73 forward, the clamping slot 812 of the fixture 800 is separated from the belt body 131 of the production conveyor belt 13, and the bearing slider 73 moves forward along the guiding sliding rail 72 to the end of the guiding sliding rail 72. Furthermore, the bearing rail 731 is in contact with the fixture sliding rail 133 on the return conveyor belt 14, and the clamping slot 812 of the fixture 800 is clamped on the belt body 131 of the return conveyor belt 14. The belt body 131 of the return conveyor belt 14 moves to push the fixture 800 along the return conveyor belt 14 to a position corresponding to the loading port 11, namely it is the end of the return conveyor belt 14. Furthermore, driven by the belt body 131 of the return conveyor belt 14, the fixture 800 slides on the fixture sliding rail 133 of the return conveyor belt 14 along the bearing rail 731 of the fixture transfer mechanism 700 to the bearing slider 73. The return drive portion 71 operates to push the bearing slider 73 forward, and the clamping slot 812 of the fixture 800 is separated from the belt body 131 of the return conveyor belt 14. Then the bearing slider 73 is moved forward along the guiding sliding rail 72 to the end of the guiding sliding rail 72, and the bearing rail 731 is in contact with the fixture sliding rail 133 on the return conveyor belt 14. Furthermore, the clamping slot 812 of the fixture 800 is clamped on the belt body 131 of the production conveyor belt 13, and the belt body 131 of the production conveyor belt 13 is moved to make the fixture 800 along the production conveyor belt 13 once again enter the production line for labeling.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. An automatic labeling production line for solid state disk, adapted for labeling a memory of the solid state disk, comprising a production conveyor belt, a plurality of fixtures disposed on the production conveyor belt for holding the memory, and a loading mechanism, a first fixture scanning mechanism, a first recycling mechanism, an automatic labeling mechanism, a visual inspection mechanism, a second fixture scanning mechanism, a second recycling mechanism and an unloading mechanism which are arranged along the production conveyor belt in turn;

wherein the fixture is provided with a fixture code, the loading mechanism is provided with a product scanning mechanism, the loading mechanism is arranged for loading the memory to the fixture at a loading port, the product scanning mechanism is arranged for detecting an original code of the memory and marking out a first defective memory, the first fixture scanning mechanism is arranged for scanning the fixture code and recording the original code and the corresponding fixture code, the first recycling mechanism is arranged for recycling the first defective memory, the automatic labeling mechanism is arranged for printing a memory label and pasting the memory label onto the memory, the visual inspection mechanism is arranged for detecting the memory label and marking out a second defective memory, the second fixture scanning mechanism is arranged for identifying the fixture code, the second recycling mechanism is arranged for recycling the second defective memory, and the unloading mechanism is arranged for unloading the memory.

2. The automatic labeling production line for solid state disk according to claim 1, wherein the production conveyor belt is a fixture conveyor belt which comprises a belt body, a drive mechanism, and a fixture sliding rail parallel to the belt body, the fixture comprises a fixture body, a placement groove for placing the memory is defined on an upper end surface of the fixture body, a fixture slider that is slidably engaged with the fixture sliding rail is disposed on a lower side of the fixture body, and a clamping slot is penetrated through a side wall of the fixture body and clamped on the belt body to move together with the belt body.

3. The automatic labeling production line for solid state disk according to claim 2, wherein a retaining groove is formed on the side wall of the fixture, a retaining cylinder is disposed at a processing position of the production conveyor belt, a positioning block is disposed at an end of the retaining cylinder and extended into the retaining groove, and the retaining cylinder is arranged for controlling the positioning block to extend out to limit the fixture.

4. The automatic labeling production line for solid state disk according to claim 2, further comprising a return conveyor belt and two fixture transfer mechanisms, wherein the return conveyor belt is also a fixture conveyor belt, the clamping slots are respectively defined on left and right side walls of the fixture body, two ends of the belt body respectively are extended to form two ends of the fixture sliding rail, one of the fixture transfer mechanisms is disposed between a first end of a fixture sliding rail of the production conveyor belt and a second end of fixture sliding rail of the return conveyor belt which are opposite to each other and is arranged for unloading the fixture on the second end of the return conveyor belt and loading the fixture to the first end of the production conveyor belt, another one of the fixture transfer mechanisms is disposed between a second end of the fixture sliding rail of the production conveyor belt and a first end of the fixture sliding rail of the return conveyor belt which are opposite to each other and is arranged for unloading the fixture on the second end of the production conveyor belt and loading the fixture to the first end of the return conveyor belt.

5. The automatic labeling production line for solid state disk according to claim 4, wherein front and rear side walls of the fixture body are provided with openings that are oppositely disposed and penetrated from left to right; the fixture transfer mechanism comprises a guiding sliding rail disposed between the production conveyor belt and the return conveyor belt, a bearing slider slidably mounted on the guiding sliding rail, a return drive portion that drives the bearing slider to move back and forth along the guiding sliding rail, and a limiting rail mounted on both sides of the guiding sliding rail and engaged with the openings on both sides of the fixture; and a bearing rail is formed on the bearing slider and connected with the fixture sliding rail.

6. The automatic labeling production line for solid state disk according to claim 1, wherein the loading mechanism comprises a feeding device and a loading conveying mechanism, the feeding device comprises a material shelf, a clamping assembly, and a lifting assembly, the material shelf has a material area for holding material trays which are for carrying the memory, the clamping assembly comprises a driving motor mounted on a body frame, two rotating shafts driven by the driving motor, and a main clamping assembly comprising two main clamping portions respectively mounted on the two rotating shafts, a separation area is formed between the two rotating shafts and located above the material area, each of the main clamping portions comprises a main cam mounted on the rotating shaft and a main clamping block following the main cam, the main cam is driven by the rotating shaft to drive the two main clamping blocks to stretch into and withdraw from the separation area, the lifting assembly is connected with the material shelf to control movement of the material shelf, and the loading conveying mechanism is arranged for clamping the memory on the material tray from the separation area and transferring the memory to the fixture on the production conveyor belt.

7. The automatic labeling production line for solid state disk according to claim 6, wherein the clamping assembly further comprises a holding assembly and a subordinate clamping assembly, the holding assembly comprises two holding portions arranged respectively on the two rotating shafts, each of the holding portions comprises a holding cam and a holding block following the holding cam, the two holding blocks are driven by the two holding cams respectively to stretch into the separation area to clamp the material tray or withdraw from the separation area to release the material tray; the subordinate clamping assembly comprises a front clamping portion located on a front side of the separation area and a rear clamping portion located on a rear side of the separation area, the front clamping portion comprises a front cam mounted on the rotating shaft and a front clamping block following the front cam, the front clamping block is driven by the front cam to stretch out or withdraw from the front edge of the separation area, the rear clamping portion comprises a rear cam mounted on the rotating shaft and a rear clamping block following the rear cam, and a guiding member fixed to the body frame and connected to the rear clamping block, and the rear clamping block is driven by the rear cam to stretch out or withdraw from the rear edge of the separation area under the limitation of the guiding member; the rotating shafts are rotatable among an initial station, a holding station, a clamping station and an unloading station, the main cams, the holding cams, and the front and the rear cams are distributed along a periphery of the rotating shaft at a certain angle, the main clamping assembly, the holding assembly and the subordinate clamping assembly are released when the rotating shaft is rotated to the initial station; the holding assembly is driven to stretch into the separation area to hold the material tray and the front clamping block is driven to stretch outwards the front edge of the separation area when the rotating shafts are rotated to the holding station; the clamping assembly is driven to stretch into the separation area to clamp the material tray, and the rear clamping block is driven to stretch outwards the rear edge of the separation area when the rotating shafts are rotated to the clamping station; and the main clamping portion is driven to clamp, the holding assembly, the front clamping portion and the rear clamping portion are driven to withdraw when the rotating shafts are rotated to the unloading station; and when the rotating shafts are rotated from the unloading station to the initial station, the lifting assembly is arranged for controlling the material shelf to approach the clamping assembly and moving the material tray on a top of a material area to the separation area at the initial station; when the rotating shafts are rotated from the holding station to the clamping station, the lifting assembly is arranged for controlling the material shelf to be away from the clamping assembly, and the material tray at the top of the material area is separated from the material shelf at the clamping station.

8. The automatic labeling production line for solid state disk according to claim 1, wherein both the first recycling mechanism and the second recycling mechanism are a defective product recycling mechanism for recycling defective memory, the defective product recycling mechanism comprises a recycling box and a recycling transmission portion, the recycling box is provided with a defective product placement area, a defective product removal area, a first conveying rail and a second conveying rail arranged between the defective product placement area and the defective product removal area in parallel, the first conveying rail and the second conveying rail are respectively slidably mounted with a recycling container for holding the memory, and the recycling transmission portion is arranged for clamping the defective memory on the production line and transferring the defective memory to the defective product placement area for unloading.

9. The automatic labeling production line for solid state disk according to claim 1, wherein each of the fixtures has N placement grooves for placing the memories, N is an integer greater than or equal to 1, the automatic labeling mechanism comprises N labeling positions, N label conveying mechanism corresponding to N labeling positions respectively, and a rolling mechanism disposed behind the N labeling positions, each of the labeling positions is provided with a third fixture scanning mechanism for scanning the fixture code, an automatic label printer for printing a memory label is arranged at a position corresponding to each of the labeling positions, each of the label conveying mechanisms is arranged for respectively transferring a memory label printed by the corresponding automatic label printer to the labeling position, and the rolling mechanism is arranged for rolling the memory label to stick the memory label.

10. The automatic labeling production line for solid state disk according to claim 9, wherein the automatic label printer comprises a label printing unit, a label output table, a label inspection unit, and a label position confirmation unit, the label printing unit is arranged for printing a memory label and outputting the memory label to the label output table, the label inspection unit is used for checking whether the memory label at the label output table is printed incorrectly, when the memory label is printed incorrectly, the label printing unit is arranged for reprinting and recycling the wrong memory label, the label conveying mechanism is arranged for gripping the memory label and conveying the memory label to a label position confirmation unit, subsequently the label position confirmation unit is arranged for confirming a position of the memory label on a robot of the label conveying mechanism, the label conveying mechanism is arranged for conveying the memory label from the label position confirmation unit to the labeling position and adjusting an angle and a position of the robot at the labeling position according to a position of the memory label on the robot of the label conveying mechanism, so that the memory label is faced to a position of the memory to be labeled on the fixture.

* * * * *